US007373881B2

(12) United States Patent
Brown et al.

(10) Patent No.: US 7,373,881 B2
(45) **Date of Patent: *May 20, 2008**

(54) FIXTURES FOR PERFORMING NEWSPAPER PRESS CUT-OFF REDUCTION

(75) Inventors: Steve Brown, St. Louis, MO (US); James Gore, Millstadt, IL (US); Wayne Geske, Naples, FL (US); Carlos F. Noa, Plainfield, IL (US); Gregory F. Tabor, Downers Grove, IL (US); Tibor Holly, Berwyn, IL (US)

(73) Assignee: Pressline Services, Joliet, IL (US)

( * ) Notice: Subject to any disclaimer, the term of this patent is extended or adjusted under 35 U.S.C. 154(b) by 323 days.

This patent is subject to a terminal disclaimer.

(21) Appl. No.: 10/940,895

(22) Filed: Sep. 13, 2004

(65) Prior Publication Data

US 2005/0034620 A1 Feb. 17, 2005

Related U.S. Application Data

(62) Division of application No. 10/458,790, filed on Jun. 10, 2003, now Pat. No. 6,829,985.

(60) Provisional application No. 60/387,538, filed on Jun. 10, 2002.

(51) Int. Cl.
*B41F 5/06* (2006.01)

(52) U.S. Cl. ..... 101/480; 101/216; 101/217

(58) Field of Classification Search ..... 101/216, 101/217, 375, 376, 479, 480, 494
See application file for complete search history.

(56) References Cited

U.S. PATENT DOCUMENTS

| | | | | |
|---|---|---|---|---|
| 3,470,816 | A * | 10/1969 | Langer et al. | 101/216 |
| 4,620,480 | A | 11/1986 | Hermach | |
| 4,677,911 | A | 7/1987 | Hermach | |
| 6,829,985 | B2 * | 12/2004 | Brown et al. | 100/35 |
| 7,121,207 | B2 * | 10/2006 | Tabor et al. | 101/480 |

OTHER PUBLICATIONS

280-MM Maintenance Manual, Goss Metroliner II Printing Units with Injector Ink System, Rockwell International, Graphic Systems Division, Oct. 1981, Revised Feb. 1988.

* cited by examiner

*Primary Examiner*—Daniel J. Colilla
*Assistant Examiner*—Kevin D. Williams
(74) *Attorney, Agent, or Firm*—Lewis, Rice & Fingersh, L.C.

(57) ABSTRACT

Systems and methods for modifying, altering, constructing, or retrofitting an existing newspaper press having a first cut-off length, to have a second cut-off length which is different from and generally less than the first. These systems and methods generally provide for the machining of new bore holes into the existing press unit frame. The new bore holes will generally completely encompass the old bore holes and allow for linear translation of the axes of rotation of the new cylinders relative to the positions of the axes for the old cylinders.

8 Claims, 17 Drawing Sheets

FIXTURES FOR PERFORMING NEWSPAPER PRESS CUT-OFF REDUCTION

CROSS REFERENCE TO RELATED APPLICATIONS

This application is a Divisional of and claims priority to U.S. patent application Ser. No. 10/458,790 filed Jun. 10. 2003, now U.S. Pat. No. 6,829,985, which in turn claims priority to U.S. Provisional Application Ser. No. 60/387,538 filed Jun. 10, 2002. The entire disclosure of both documents is herein incorporated by reference.

BACKGROUND OF THE INVENTION

1. Field of the Invention

This disclosure relates to the field of newspaper presses. In particular, to the reboring of plate and blanket cylinder bores of existing newspaper presses to allow for the use of differently sized plate and blanket cylinders in the press.

2. Description of the Related Art

One natural resource which has gained a lot of attention recently is paper. In the last few years, paper recycling to reuse discarded paper has become a much more common activity and has become, for many, a big business. Further, as increased political pressure is brought to bear on paper use and paper recycling, paper has generally increased in price to accommodate increased recycling as well as to encourage more efficient use of new and recycled paper.

For a newspaper, the cost of the raw newsprint upon which to print the newspaper can be the most important consideration in whether the newspaper can survive in the marketplace and can be the most significant cost in operating the newspaper. In today's world, a newspaper must compete against radio, television, and the Internet for its share of advertiser's dollars spent towards reporting. As these other technologies are not bound by the use of paper, the cost of raw newsprint can determine whether or not a newspaper can compete and ultimately survive. Newsprint pricing regularly fluctuates on a quarterly basis which can often leave the newspaper uneasy about how the bottom line will look at the end of the year as even a small fluctuation can cancel out the profit margin built into the paper at the beginning of the year.

Most newspaper press lines running today were installed in the 1970's and 1980's before newsprint prices were inflated to the point they are today, when newsprint prices were more stable, and before the need to conserve paper was fully understood. When these presses were installed, the printed size of a page of a newspaper and therefore the size and design of the newspaper presses was generally selected to obtain a particular look of the newspaper or to allow a particular number of articles of a particular size to appear on various pages, instead of to preserve newsprint. For this reason, many of these presses utilize newspaper pages which are larger than their more modern counterparts. In the newspaper business, this difference in the newspaper size can result in a massive difference in profitability in the market.

In a newspaper, there are effectively two dimensions of the paper which can be controlled and which determine the amount of paper which is required to print each newspaper. A single sheet of newspaper (the pages which connect in the middle and printed on each side (four pages)) is generally a quadrilateral shape. A newspaper printing press will generally print newspaper pages on a roll of paper (or a paper web as it is often called). This web is printed with multiple sheets across the width of the paper roll (two or more sheets or eight or more pages) with these same pages repeated down the roll of paper. Alternatively, the press may print a first row of sheets, and then a second (or even third) row below that, before repeating the same pattern of rows. In this way, the newspaper sheets are essentially printed repetitively (serially) on the roll as it is unwound.

This design results because the press generally utilizes a continuously revolving cylinder as the printing surface to print the page. The cylinder has a length corresponding to the width of the paper roll and generally prints two or four sheets with each revolution (or half revolution) down the length of the roll. Different sheets are printed on a different paper roll (generally on a different press unit) with the newspaper comprising the appropriate sheets from a plurality of press units being properly arranged, cut and folded together.

As the pages are generally printed upright, to utilize a smaller horizontal dimension, a narrower paper roll is used and the press is set up to not utilize the entire length of the printing surface but only that which corresponds to the width of the roll (the ends of the printing cylinder are contacting only empty space as there is no paper to contact), Alternatively, a wider paper roll could be used utilizing more of the length of the printing cylinder and the system could be set up to print more sheets along the width of the paper. For example two and a half narrower sheets (10 pages) or even three narrower sheets (12 pages) may be printed along the width of a slightly wider roll of paper.

Because of the way the newspaper press is designed, while this horizontal dimension modification is fairly easy, it is difficult to change the height dimension of a newspaper or what is generally called the "cut-off" or "cut-off length." The printing cylinder has a fixed circumference and because the cylinder endlessly rotates providing the repeated pattern of pages, the circumference of the cylinder corresponds to a predetermined number of complete pages. If the page length is shortened without changing the circumference of the cylinder, while the resultant newspaper size may be decreased, the cylinder still "prints" the section which had previously been used, it is just blank and is either still included in the resultant newspaper as simply a wide margin, or is somehow discarded as waste. Such a system does not save any paper.

In some dynamic presses, the printing cylinder could be modified dynamically so that a continuously changing pattern of repeating pages could be printed to allow for a printing cylinder to print a non-whole number of pages with each revolution, but such a dynamic system would be very expensive and difficult to operate making it unusable for most newspaper printing operations.

In order to alter the cut-off length of the paper in a conventional press line, either the pages must be made an equal subdivision of the existing page size (e.g. a print cylinder which has a circumference of one sheet can be made to print two sheets of half the original height) or the circumference of the printing cylinder must be changed. While the first of these concepts reduces the page size, it does not necessarily reduce the paper use as the newspaper will simply print twice as many half size pages. Further, a newspaper of half size often requires a completely different layout to be accepted by readers resulting in different problems. Therefore, the best solution is to have the press print the paper using a printing cylinder of a smaller diameter (and therefore a smaller circumference resulting in a decreased cut-off length).

While decreasing the printing cylinder diameter sounds like a relatively simple operation, with an existing press the printing cylinders and other components of the press are arranged to interact with each other by contact at their circumferential surfaces. If the printing cylinders diameters are simply decreased, necessary interactions will not occur and ink will not be correctly transferred to the paper web. Instead, cylinders of a decreased diameter generally require a closer, more compact arrangement where the axes of the cylinders are placed closer to each other.

Existing press units are large, heavy, and expensive pieces of machinery. The press unit principally comprises a large frame formed out of a material such as cast iron or steel with holes bored therethrough to enable the attachment of the various moveable components in a precise relation. Because of this design, switching to a smaller print roller currently requires completely replacing most, if not all of the existing press line as the press units generally cannot be modified to have mounts suitable for the new printing cylinders. While this is a viable solution in some cases, most of the time it is cost prohibitive as presses on a single press line (generally 6 or more printing units, a folder and related structures) would all need to be replaced simultaneously, which is a massive capital expense.

Many newspaper press lines in use today that were installed prior to the interest in paper reduction utilize a newspaper page height of 22", 22¾", or 23⁹⁄₁₆". Today, new newspaper press lines are installing new presses that print at a 21" length to save paper. These presses can save 8% to 10% of the newsprint over what an older press uses which is a gigantic savings in cost and materials. There is therefore a need in the art to have systems and methods for allowing an older press unit utilizing a first cut-off length, to be modified so as to have a new shorter cut-off length.

SUMMARY

For these and other reasons known to those of ordinary skill in the art, described herein are systems and methods for modifying, altering, constructing, or retrofitting, an existing newspaper press having an existing cut-off length, to have a new cut-off length which is different from and generally less than the existing cut-off length. These systems generally provide for the machining of new larger bore holes into the existing press unit frame. The new bore holes completely encompass the old bore holes and allow for linear translation of the axes of rotation of the new cylinders relative to the positions of the axes for the old cylinders.

In an embodiment, there is described a method for converting a newspaper press unit to produce a different cut-off length, the method comprising: providing a press unit located as part of a press line, the press unit having a press unit frame supporting existing blanket cylinders and existing plate cylinders in existing blanket bore holes and existing plate bore holes respectively; removing the existing blanket cylinders and the existing plate cylinders from the existing blanket bore holes and the existing plate bore holes; attaching a plate bore aligning fixture to the frame, the plate bore aligning fixture having a portion aligned to the existing blanket bore holes; boring, based on the plate bore aligning fixture, new plate bore holes, the new plate bore holes having a diameter greater than the existing plate bore holes and encompassing the existing plate bore holes; removing the plate bore aligning fixture; attaching a blanket bore aligning fixture, the blanket bore aligning fixture having a portion aligned to the new plate bore holes; boring, based on the blanket bore aligning fixture, new blanket bore holes, the new blanket bore holes having a diameter greater than the existing blanket bore holes and encompassing the existing blanket bore holes; removing the blanket bore aligning fixture; placing new plate cylinders and new blanket cylinders having a new diameter in the new plate bore holes and the new blanket bore holes respectively; and using the new plate cylinders and the new blanket cylinders to print a newspaper having a different cut-off length.

In an embodiment of the method at least one of the new plate cylinders and/or new blanket cylinders is mounted by placing journals of the plate cylinder and/or blanket cylinder in a mounting hole in a sleeve, and placing the sleeve, which may have a cap attached thereon, in the new plate bore hole or new blanket bore hole.

In an embodiment, the cut-off length is changed to 21 or less inches and may be changed from 21½ inches, 22 inches, 22¾ inches, or 23⁹⁄₁₆ inches In another embodiment, the plate bore aligning fixture is one of a set of two plate bore aligning fixtures, one of the set of two plate bore aligning fixtures attaching to an operator side of the press unit and the other of the set of two plate bore aligning fixtures attaching to the drive side of the press unit and/or the blanket bore aligning fixture is one of a set of two blanket bore aligning fixtures, one of the set of two blanket bore aligning fixtures attaching to an operator side of the press unit and the other of the set of two blanket bore aligning fixtures attaching to the drive side of the press unit.

In another embodiment, both steps of attaching include aligning the fixture by using a circle part.

In still another embodiment there is described a method for machining new bore holes for mounting blanket and plate cylinders in a printing press, the method comprising: providing a newspaper press located as part of a press line; removing from the press old blanket cylinders and old plate cylinders from old blanket bore holes and old plate bore holes respectively; attaching a first fixture, the first fixture being aligned with the axes of the old blanket bore holes or the old plate bore holes; boring, based on the fixture, a first set of new bore holes; removing the first fixture; attaching a second fixture, aligned with the axes of the first set of new bore holes; boring, based on the fixture, a second set of new bore holes; removing the second fixture; and placing new plate cylinders and new blanket cylinders having a new diameter in the first and second sets of new bore holes.

In a still further embodiment, there is described a fixture for use in machining new bore holes for mounting blanket and plate cylinders in a printing press unit, the fixture comprising: a frame comprised of a rigid material; at least one alignment hole machined through the frame; and at least one bore hole guide machined through the frame; wherein the at least one alignment hole is aligned to at least one of a plate bore hole or a blanket bore hole of a printing press unit frame; and wherein, when the at least one alignment hole is so aligned, the bore hole guide indicates a position to machine a new hole in the printing press unit.

In a still further embodiment, the fixture is one of two fixtures in a set of fixtures and/or the fixture is separable into at least two parts.

DESCRIPTION OF PREFERRED EMBODIMENT(S)

Figure 1:
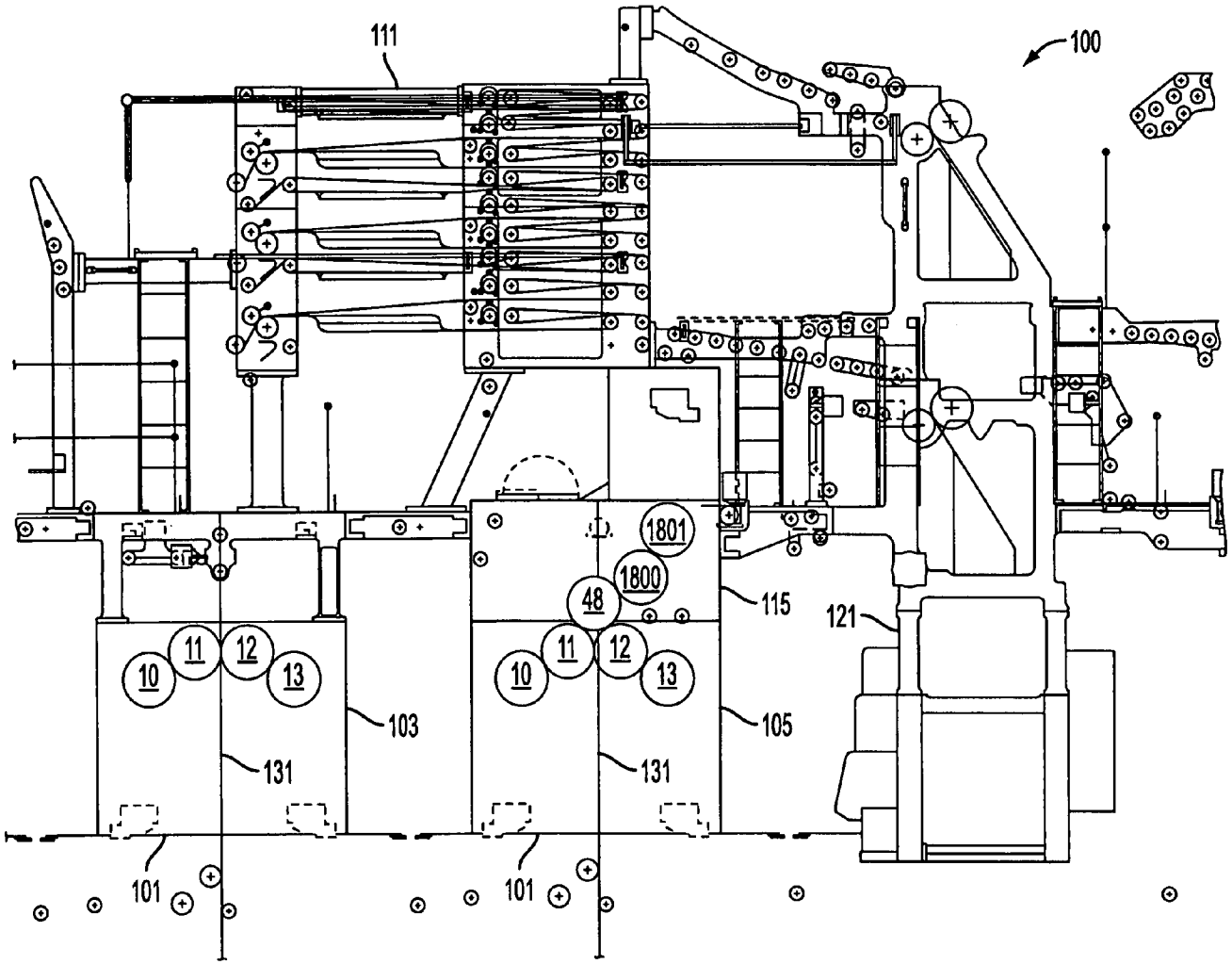
FIG. 1 (PRIOR ART)
FIG. 1 provides a drawing of a portion of a press line of the prior art showing two printing units (a three color unit and a standard unit) as well as a folder and some of the angle bars for interacting with the paper web.

While the embodiments described below discuss the systems and methods used in the modification of existing printing presses having an existing cut-off of 21½", 22", 22¾", or 23⁹⁄₁₆" being adapted to have a cut off of 21" or less, one of ordinary skill in the art would understand that these systems and methods could be used which are designed to reduce the cut-off length of any original cut-off length press unit to any other value. Further, the systems and methods could also be used to increase the cut-off length if such an increase was desired.

The discussion below will also discuss modifications made to the frame of a press unit. This discussion presumes that the frame of the unit is accessible and that any coverings or casings from the press unit have previously been removed in a manner known to one of ordinary skill in the art and that the press being modified is suitably accessible to perform these modifications on. For this reason, all drawings herein generally show the frame of a press unit utilizing general iconographic representation as opposed to any one particular look. The press unit modified in the discussion herein utilizes offset lithography as the printing technique. This is by no means required and the technique could be used on a press utilizing any type of printing technique. Bore hole placement and the exact positioning of relationships in the figures are intended to be demonstrative, and are not necessarily to scale.

The systems, and methods will be discussed in terms of their application principally to a standard press unit and will occasionally be expanded to a half deck for integration on the standard press unit to apply the systems and methods to a three color unit. One of ordinary skill in the art would understand that the techniques could also be applied to other standard units, half deck units, full deck units, three color units, four color units, and/or tower units utilizing the same principles and without undue experimentation. The systems and methods here may in fact be used to provide for the necessary linear translation of axes of rotation in any press system utilizing printing cylinders.

One of ordinary skill in the art would also understand that the discussion herein is focused on how to modify an existing press unit so that the press unit operates with plate and blanket cylinders of smaller diameters. With this alteration making the resulting newspaper smaller, it is also likely that other components of the press line would have to be altered to accommodate this change. Angle bars, idle rollers, and other components may need to be moved to correctly calibrate the press line to accommodate the smaller page size. Further, the folder would also need to be modified to cut the pages at the correct length. While these modifications would all be considered part of the modification of the press line so as to enable the creation of newspapers with the decreased cut-off length and part of this invention, a detailed discussion of these modifications is beyond the scope of this disclosure which will focus on systems and methods related to the press unit itself so as to enable the press unit to be able to mount smaller diameter printing cylinders in a fashion such that a web of paper is correctly printed by the press unit.

To begin the discussion it is best to first look at the design of a press line in a standard newspaper press floor. FIG. 1 shows a general layout of a portion of an exemplary press line (100) as might be used in any major newspaper to print pages which are primarily black and white with so-called "spot" color or occasional full color pages. The press line (100) includes at least one press unit (101), a series of angle bars (111) and a folder (121). While the press line of FIG. 1 shows two press units (101), one set of angle bars (111) and a single folder (121); most press lines will have a folder (121) and two sets of angle bars (111) with between 4 press units (101) to 10 press units (101) depending on the desired capacity and design of the press line (100). Further, a single press room may have one or more than one press line, again depending on capacity and design, which may operate independently, or may operate in conjunction with each other. For the purpose of this disclosure, it will be presumed that the press line include at least one press unit (101) and any other associated structure necessary which operates in the standard manner known to those of ordinary skill in the art.

The press units (101) may be any type of press unit (101) but will generally be either standard units (103), three color units (105) (which is usually a standard unit (103) with a half deck unit (115) placed thereon), four color units (which is usually a standard unit (103) with a full deck unit (not shown) placed thereon) or tower units (not shown). The half deck (115) shown would be considered a "13 side" half deck based on its arrangement, a "10 side" half deck would be considered essentially interchangeable and would be arranged in a mirrored position. The type of press unit (101) depends upon the flexibility originally built into the press line (100). A pure black and white press line (100), for instance, will generally only have standard units (103), while a press line (100) utilizing some color (spot or process color) may have some three color units (105), four color units and/or towers. Full color press lines or press lines designed to be highly versatile, may comprise all tower press units.

Regardless of the exact press units (101) used, the press line will generally operate in a similar fashion. Paper (131) will be fed from a paper roll to the press units (101) generally from underneath the press units (101). The paper (131) will be of a predetermined width and will generally be provided on a large diameter roll containing a length many times greater than the height of any particular newspaper page. The page will generally be printed upright so that if the roll of paper is viewed before cutting, there will be a predetermined number of pages arranged side to side across the width of the roll, with the same pages repeated serially down the roll as it unwinds and is printed. The exact width of the paper roll is selected based on the width of the press unit (101) and the desired size of the resultant pages.

As the paper (131) comes up through the press unit (101), ink and dampener solution are transferred from various troughs or other storage devices onto a series of transfer rollers. Eventually the ink and dampener solution are applied to a plate cylinder (10) or (13). While the term "cylinder" is used for some components while "roller" or "drum" is used for others, this is done for convenience and does not imply any structure to any component which could not be encompassed through the use of a different term. Plate cylinder (10) or (13) includes the necessary structure to allow for the ink to be placed into the correct format so as to form the necessary text or images to be printed. This may be the actual shape to be printed (as would be the case in offset lithography) or may be a reverse image. The plate cylinder (10) or (13) then transfers the ink to blanket cylinder (11) or (12) (forming a reverse image in offset lithography) which then transfers the ink to the paper (131) printing the page. Both sides of the page are generally printed simultaneously by the two blanket cylinders (11) and (12) in a standard press unit (103). If a three color press unit (105) is used, the paper (131) may be routed through an additional plate cylinder (1801) and blanket cylinder (1800).

It is important to note that the reference numbers chosen for the plate (10), (13), and (1801) and blanket (11), (12), and (1800) cylinders in this disclosure were specifically chosen. Various references related to these cylinders utilizing these same reference numbers are known in the industry. Therefore, the choice of reference and depicted side implies which side of the press unit (101) is being viewed (and that the half deck discussed is a "13 side" half deck as opposed to a "10 side" half deck, although the description herein could be readily adapted to a "10 side" half deck). While the systems and methods can obviously be reversed if the system is being accessed from a different side, this use of reference numbers does help to provide for a particular indication of particular structure as generally no other distinguishing characteristics of the press unit (101) are used. In the case of FIG. 1 the choice of reference numbers shows that the view is from the operator side of the press.

Generally, the printing is accomplished by ink being transferred from the blanket cylinder (11), (12), or (1800) to the paper (131). In order to print cleanly, the paper (131) cannot be suspended over the blanket cylinder (11), (12) or (1800), but the blanket cylinder (11), (12), or (1800) must be allowed to push against a surface (generally another revolving cylinder) to transfer the ink to the paper (131) and cleanly print the page. In the standard press unit (103), the two blanket cylinders (11) and (12) push against each other printing both sides of the page simultaneously with each cylinder creating the surface for the other cylinder to push against. In the three color unit (105), there is included a common impression cylinder (48) which may be pressed against by any or all of the blanket cylinders (11), (12), or (1800) to provide the necessary surface.

Once the paper (131) has been printed by any particular press unit (101), it may be routed through additional press units (101) (or may go back through the same press unit (101)) to add additional color or colors by contacting another blanket cylinder (11), (12), and (1801) and will eventually be routed through the angle bars (111). These angle bars (111) provide for various changes in direction, orientation and/or delay in the various rolls of paper (131). As each roll of paper (131 ) is printed to become a collection of pages repeated serially, in order to form a newspaper having many different pages, the pages being printed by a first press unit (101) are different from the pages being printed by a second press unit (101). The angle bars (111) may also include cutting instruments to separate the sheets and/or pages printed side by side, effectively narrowing the width of the paper web where necessary. The primary purpose of the angle bars (111) is to arrange the various individual paper webs with each other so as to align the components of the resultant newspaper correctly. Generally, when the paper (131) leaves the angle bars (111) the various rolls have been arranged with their major surfaces over each other, and with different pages arranged over top of each other so that numerical ordered pages are logically arranged. Further, the repetitions of one paper roll (131) are aligned with the repetitions of the other paper rolls (131).

The paper rolls (131) are then fed into the folder (121) which cuts the individual newspapers apart. In particular, the folder (121) separates the individual newspaper sheets from the web of sheets all arranged on the series of rolls (131). Once cut, the folder (121) may arrange the pages as additionally necessary, and fold the resultant newspaper into the form found on the newsstand.

As has previously been discussed, this disclosure will focus on how to adapt the press units (101) to accommodate the use of smaller plate (10), (13), and (1801) and blanket (11), (12), and (1800) cylinders so as to print the paper rolls (131) with pages of a decreased height. From the above discussion, it should be clear that there are various important interrelationships which have to exist within the press unit (101) to allow the press unit (101) to actually print the page. These relationships are best illustrated by indications of the placement of various of the cylinders relative to each other.

Figure 3:
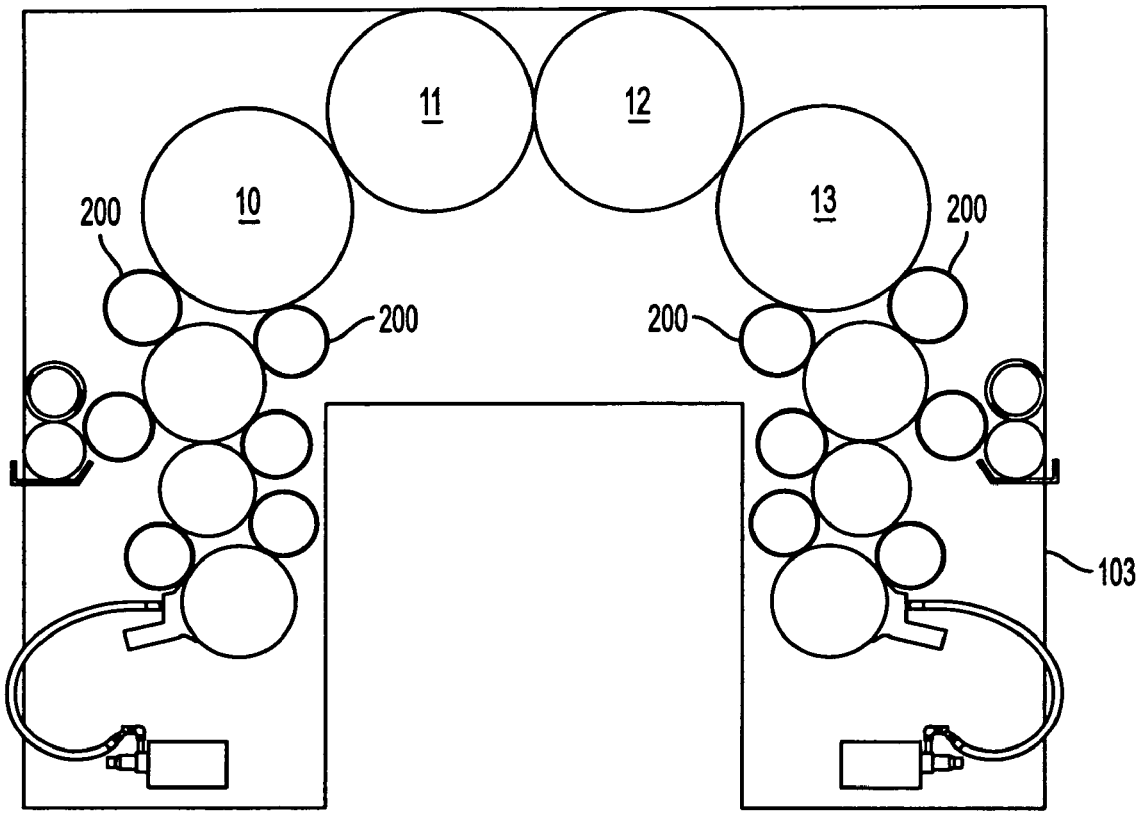
FIG. 3 (PRIOR ART)
FIG. 3 provides a drawing of the side of a standard press unit of the prior art showing the interactions between the various cylinders.
Figure 4:
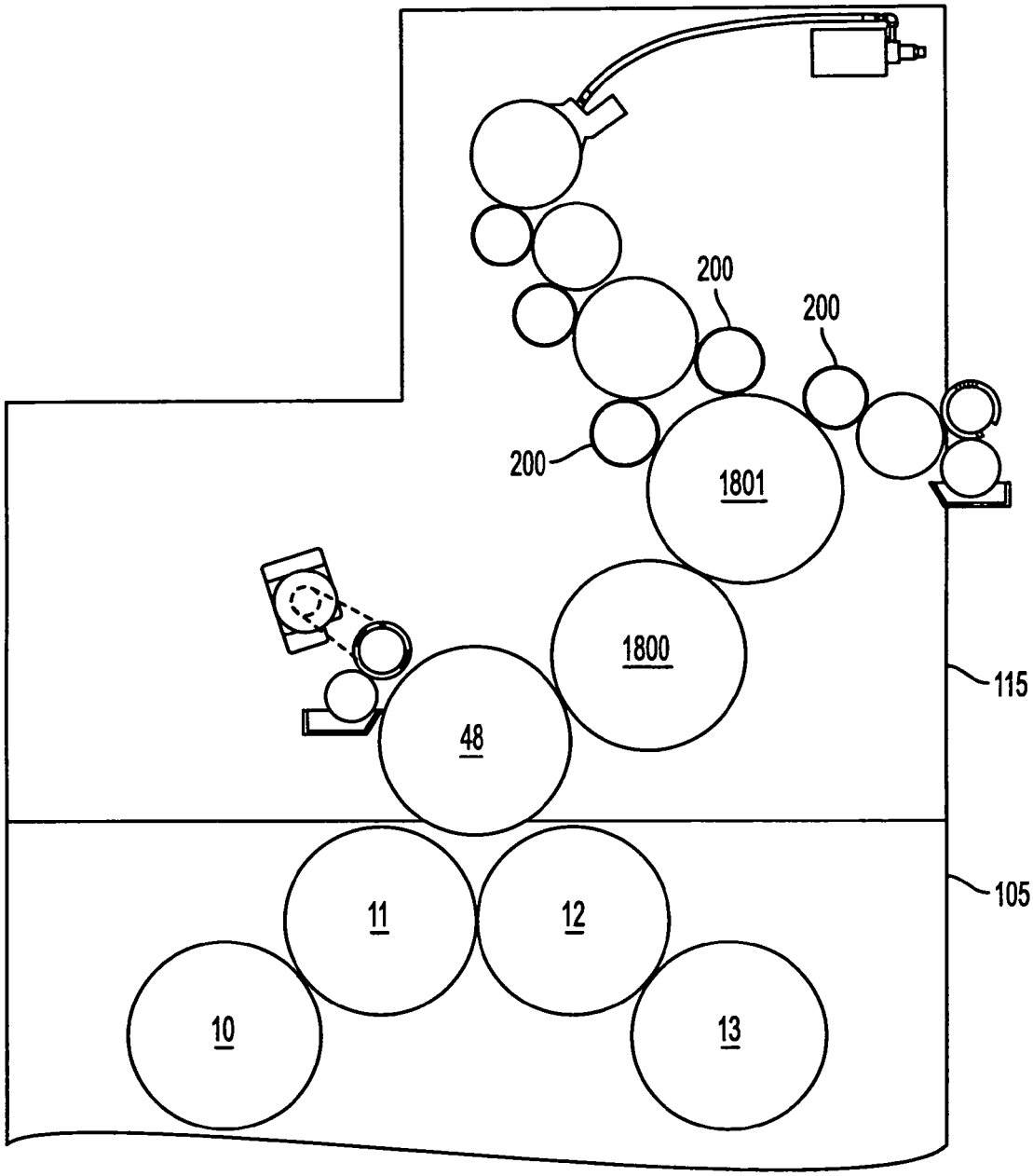
FIG. 4 (PRIOR ART)
FIG. 4 provides a drawing of the side of a half deck press unit mounted on a standard unit (forming a three color unit) of the prior art showing the interactions between the various cylinders.

The relationships of a standard press unit (103) and a three color press unit (105) are shown in FIGS. 3 and 4 respectively.

As is clear from FIG. 3 the two blanket cylinders (11) and (12) in a standard press unit (103) must be able to have their circumferential sides touch each other (or be able to both simultaneously touch opposing sides of the paper (131), more accurately) during printing. Otherwise, ink could not be transferred from the blanket cylinders (11) and (12) to the paper (131). In the three color unit (105) of FIG. 4, the blanket cylinders (11), (12), and (1800) preferably must each be able to have their circumferential sides touch each other, and/or preferably also need to be able to alternatively and additionally be able to touch the circumferential side of the common impression cylinder (48) which is a cylinder designed to allow a blanket cylinder (11), (12), or (1800) to print one side of the paper (131) without having to print the other side of the paper (131) at the same time.

Each of the circumferential sides of the blanket cylinders (11), (12), and (1800) in turn touches the circumferential side of a corresponding plate cylinder (10), (13), and (1801) to allow for correct transfer of ink from the plate cylinder (10), (13), or (1801) to the blanket cylinder (11), (12), or (1800) so that the ink can be transferred to the page. Further, the circumferential side of each plate cylinder (10), (13), and (1801) in turn touches the circumferential side of various inking and dampening rollers (200) which are in touch with other transfer rollers to transport the ink and dampener solution to the plate cylinder (10), (13) or (1801) from appropriate storage of either.

The various arrangements of cylinders exist so that ink and dampener solution are transferred to the plate cylinders (10), (13), and (1801) and blanket cylinders (11), (12), and (1800) to be transferred to the paper (131) in the correct manner. In the standard unit (103), the organization of printing (the two blanket cylinders (11) and (12) simultaneously printing both sides of the paper (131)) is generally fairly fixed, while in the three color unit (105), multiple different paper paths can be used depending on the type of printing to be performed. Therefore, more flexibility is needed as which blanket cylinder(s) contact which other parts is variable. For this reason, the common impression cylinder (48) is included. As should be clear from this discussion, the press unit (101) is not really dependent on the exact positioning of the printing cylinders relative to any fixed location of the press unit frame in which all the units are mounted, but is instead dependent on a relationship between the various cylinders and some other locations on the frame such as ink supplies.

In particular, each blanket cylinder (11), (12) or (1800) must be able to contact another blanket cylinder (11), (12) or (1800) and/or the common impression cylinder (48) to print the page. Further, each plate cylinder (10), (13) or (1801) must be in contact with a blanket cylinder (11), (12) or (1800), and each plate cylinder (10), (13) or (1801) must be in contact with ink and dampener rollers (200) (and the roller train) to obtain those substances. As previously discussed, to decrease the cut-off length, the diameter of the actual printing cylinders is preferably decreased. Therefore, the blanket cylinders (11), (12) and (1800) have a decreased diameter. Further because of the relationship of the blanket cylinders (11), (12) and (1800) to the plate cylinders (10), (13) and (1801), the plate cylinders (10), (13) and (1801) must also have an equal decrease in size. In adapting the press unit (101) to operate with these new cylinders, other components (such as ink drums, dampener rollers, and the common impression cylinder (48)) may be essentially freely altered as they do not directly effect the resultant cut-off length. For this reason, appropriately arranging the new plate (10), (13) and (1801) and blanket cylinders (11), (12) and (1800) relative to each other (and to a lesser extent to the common impression cylinder (48)) is the critical operation to retrofitting an existing press to have a decreased cut-off length. The remainder of this discussion focuses on how to adapt the mounting positions of these cylinders so that the press can accommodate and use them. For simplicity, the remaining discussion no longer utilizes the reference numbers for blanket cylinders (11), (12) or (1800) or plate cylinders (10), (13) or (1801) as the discussion can apply equally well to any or all of them, and in some embodiments they would be considered interchangeable.

To understand how the blanket, press and common impression cylinder (48) operate in practice (as these are the principle cylinders, the ink drums and dampener rollers simply need to be of a sufficient design to transfer ink and dampener solution to these cylinders), it is logical to first understand how these cylinders are attached in the press unit (101) and how they serve to print the page.

First, as is apparent from the above discussion, the plate and blanket cylinders are generally rounded and print a planar surface which is the newspaper page. The printing occurs by having what will be the page pushed against the circumferential side of the blanket cylinders. The paper is then pulled through the cylinders as the cylinders rotate, transferring the image. Once the cylinder has completed one complete rotation, the image on the cylinder is printed again immediately following the prior page. In this way the repeated serial pattern of pages is obtained.

In order to decrease the cut-off length, therefore, the diameter of the blanket and plate cylinders needs to be decreased, while at the same time, the various blanket and plate cylinders, as well as the common impression cylinder and ink and dampener transfer rollers need to still be touching as discussed in conjunction with FIGS. 3 and 4 to allow for correct ink transfer and accurate printing.

In order to maintain the relationships, while still simultaneously decreasing the diameter of the plate and blanket cylinders (to decrease the cut-off length), the rotational axes of the new cylinders will need to be linearly translated from the rotational axes of the existing cylinders. If smaller circles are placed on FIGS. 3 or 4 on the same axes, the cylinders would clearly not touch, which would result in a failure to correctly print. The systems and methods herein relate to how to accurately translate these axial positions, and how to modify the press unit (101) so as to use and support the new cylinders.

Figure 2:
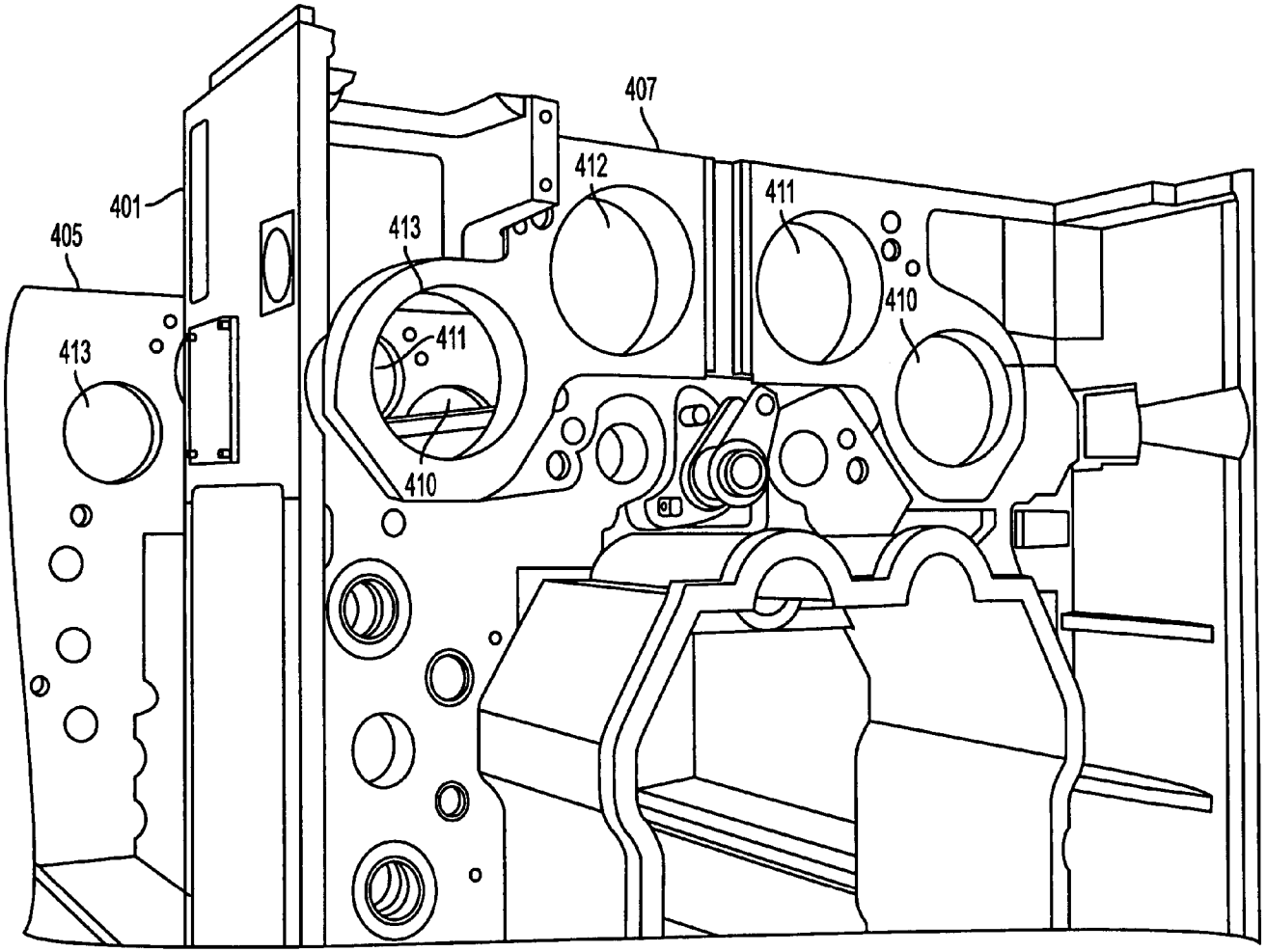
FIG. 2 (PRIOR ART)
FIG. 2 provides a perspective view of an embodiment of a frame of a standard press unit of the prior art, with the plate and blanket cylinders and the ink transfer and dampener solution transfer rollers removed for clarity.

Generally, the press unit (101) comprises a large rigid frame (401) generally of cast iron or steel which supports the various cylinders and allows them to rotate appropriately relative to each other. FIG. 2 provides a perspective view of one such embodiment of a frame (401). This frame generally comprises an open sided and open topped trough-style shape having a bottom surface (403) and two sides (405) and (407). Each of the sides (405) and (407) includes a series of four large bore holes (410), (411), (412), and (413) which are mounting locations for the plate and blanket cylinders. These bore holes are essentially identical on each side of the frame (401) so that the cylinders are suspended generally horizontally in the space above the bottom surface between the two sides. For side reference, the bore holes (410), (411), (412), and (413) refer to the positions of the cylinders (10), (11), (12), and (13) as discussed earlier.

Figure 5A:
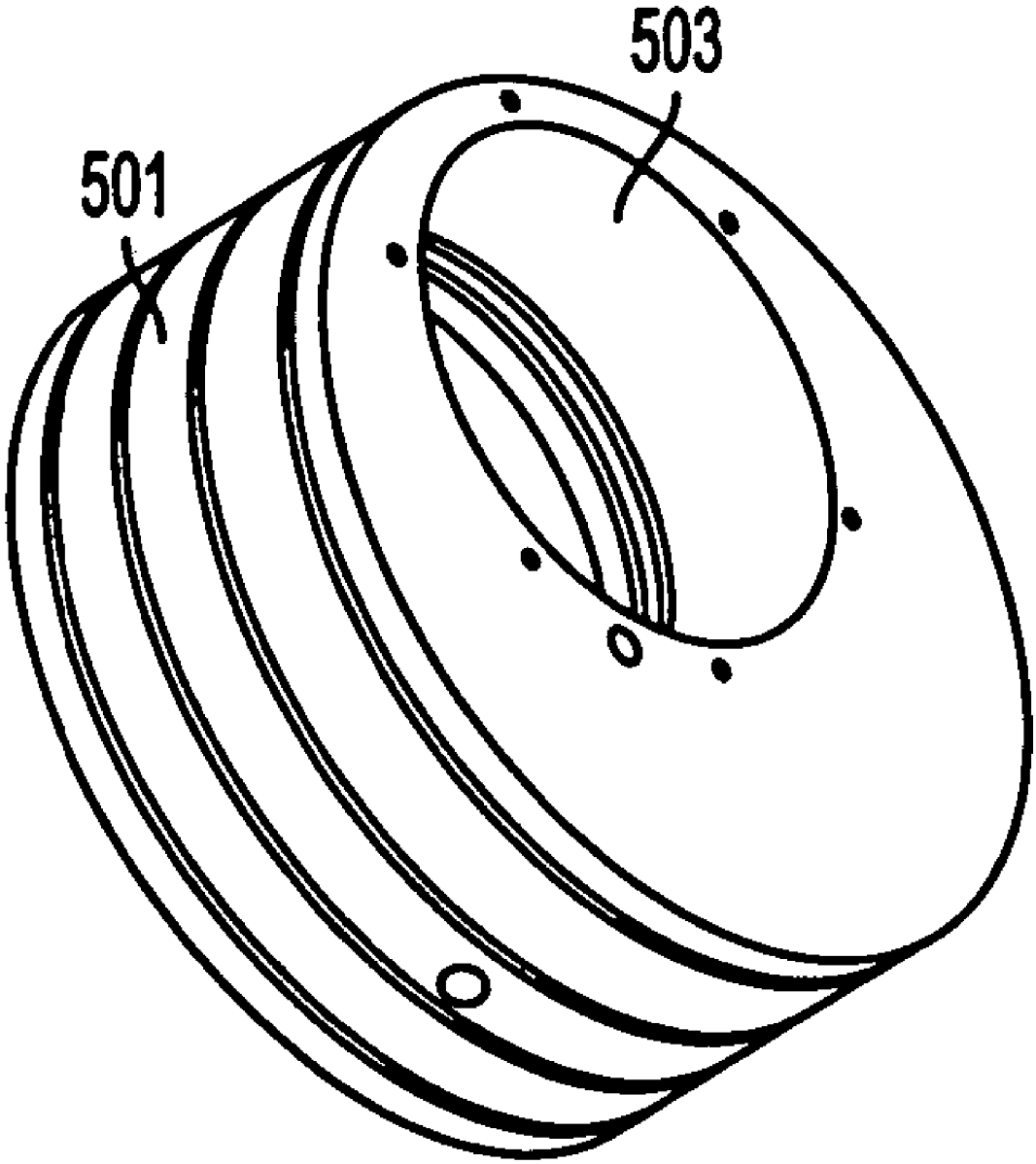
FIG. 5A provides a perspective view of an eccentric sleeve including a mounting hole therethrough.
Figure 5B:
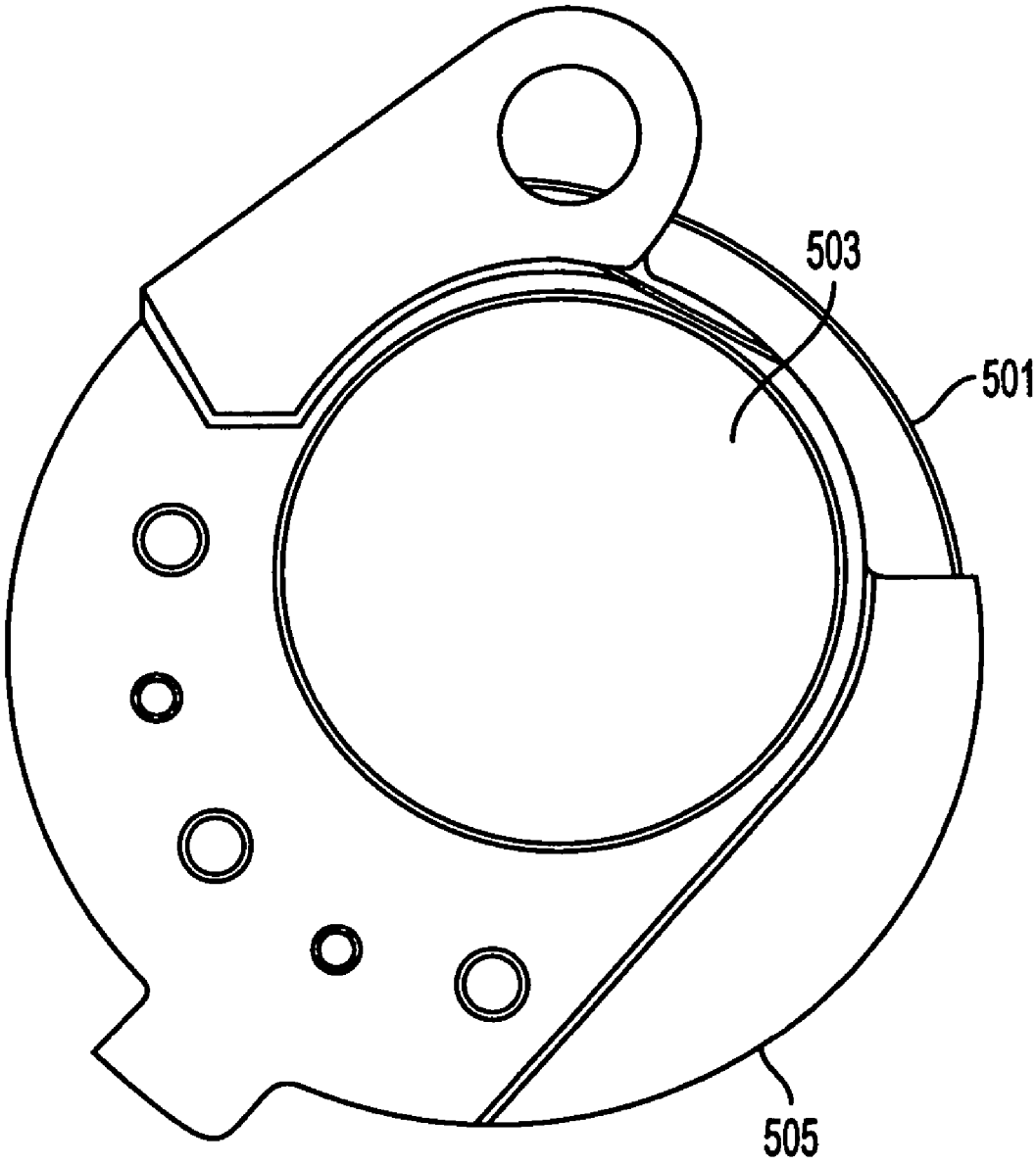
FIG. 5B shows the eccentric sleeve of FIG. 5A with an assembly cap mounted thereto.

In order to provide smooth rotation of the cylinders, as well as improved functionality in loading and unloading paper, each bore hole (410), (411), (412), and (413) generally has placed therein a sleeve (501), which is sized and shaped to fit in the bore hole (410), (411), (412), or (413). An example of a sleeve (501) is shown in FIG. 5A. In some embodiments, the sleeve (501) may be allowed to move (rotate) within the bore hole being locked into place generally only when printing is occurring. This would generally be utilized by a blanket cylinder and may have the sleeve (501) placed in a cap (505) as shown in FIG. 5B to facilitate the movement. Alternatively, the sleeve (501) may be arranged in the bore hole in a fixed orientation. This is generally utilized by the plate cylinders. Each sleeve (501) has included therein a mounting hole (503). This mounting hole (503) is a generally circular hole arranged within the structure of the sleeve (501) to allow the journal of the appropriate cylinder to rotate therein providing for the axial rotation of the cylinder during printing. The center of the mounting hole (503) therefore corresponds to the rotational axis of the cylinder. To facilitate frictionless rotation, the mounting hole (503) is often lined with a series of ball bearings or similar materials. When assembled, the appropriate cylinder is rotationally connected in a mounting hole (503) towards each end, the corresponding sleeves (501) are mounted in the appropriate bore holes (410), (411), (412), and (413), and the cylinder is suspended between the two sides of the frame (401) so as to be supported by the frame (401).

The sleeve system is often used because the mounting hole (503) may be slightly offset in the sleeve (501) (the mounting hole (503) and sleeve (501) do not share the same axis making the sleeve eccentric) to provide for additional functionality. In particular, the sleeve (501) may be rotated in the appropriate bore hole (410), (411), (412), or (413) (about the axis of the sleeve or bore hole, which is offset from the axis of the mounting in this embodiment) to allow the cylinder associated therewith to be moved into or out of contact with various other cylinders and or the paper (131).

As should be apparent from these descriptions and FIGS., if smaller cylinders are placed in the various mounting holes (503) and bore holes (410), (411), (412), and (413), the cylinders will be too far away to touch, generally regardless of how the sleeve (501) is rotated. Therefore, there are essentially three different factors which need to be taken into account to use the new cylinders in the existing press frame (401). Firstly, the new mounting hole (503) axis will be translated relative to the existing mounting hole (503) axis. Secondly, this translation will generally also result in a translation of the mounting hole (503) axis from the existing bore hole (410), (411), (412), or (413) axis. Thirdly, the mounting hole (503) needs to be contained within the sleeve (501) (within the bore hole (410), (411), (412), or (413)) to preserve movement of blanket cylinders so as to allow a standard deck (103) to have a half deck (115) or full deck placed thereon to form a three color or four color press unit.

In a first embodiment, the necessary translation related to the first two factors is not enough to place the mounting hole (503) outside the sleeve (501) (and allows sufficient structure of the sleeve (501) to be around the mounting hole (503) for structural integrity) that the refit can be performed by machining a new sleeve (501) where the axis of the mounting hole (503) is moved radially further from the axis of sleeve (501). While in some situations this technique can be used to decrease the size of the cylinders used, it has only limited availability as most of the necessary reductions require translation greater than the available radius of the sleeve (501). This is particularly true with the plate cylinders where the translation may be as much as three times the necessary translation of the mounting hole (503) for the blanket cylinders.

Figure 6:
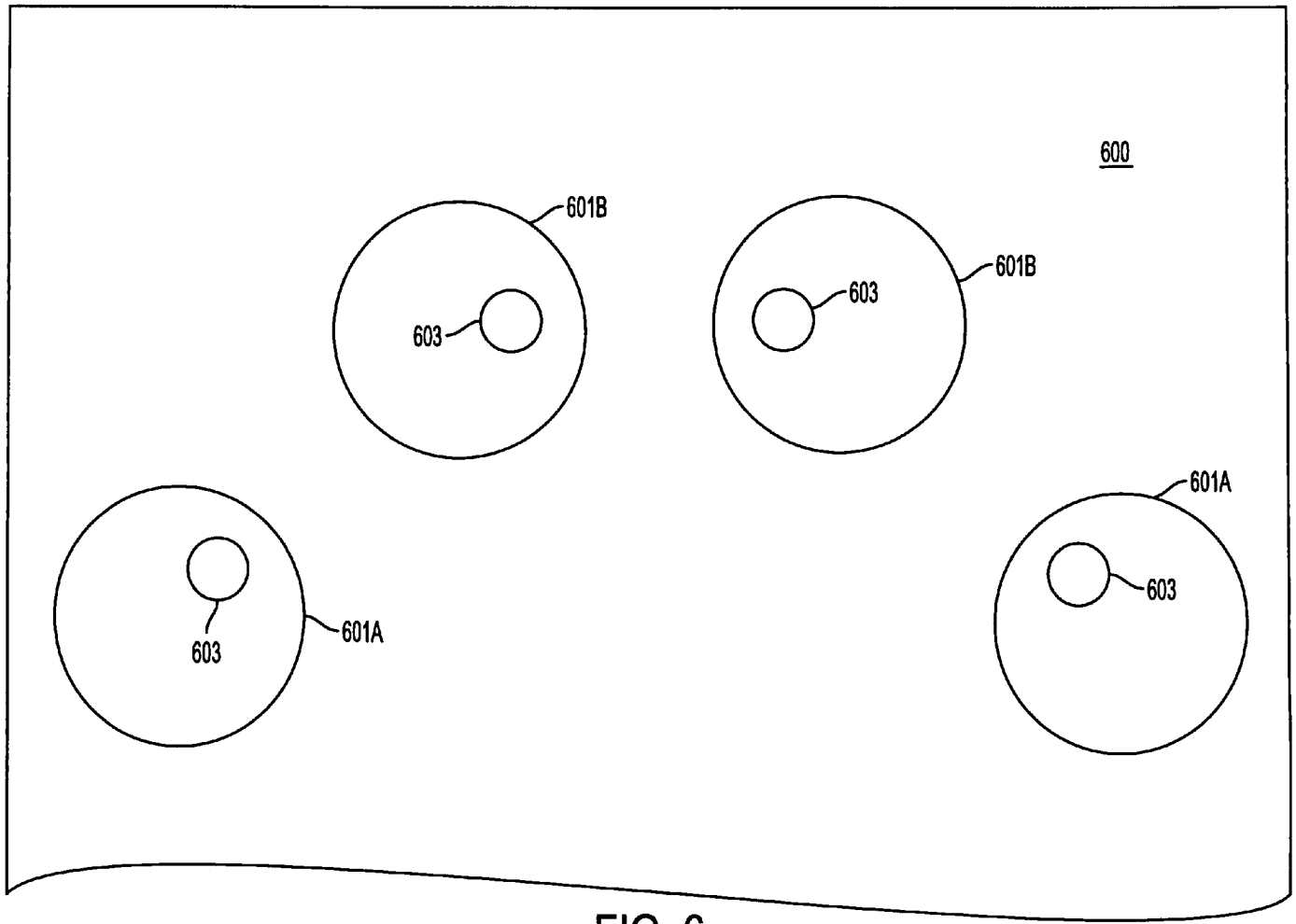
FIG. 6 provides a drawing of the side of a standard press unit showing the bore holes and the mounting holes for the existing plate and blanket cylinders.
Figure 7:
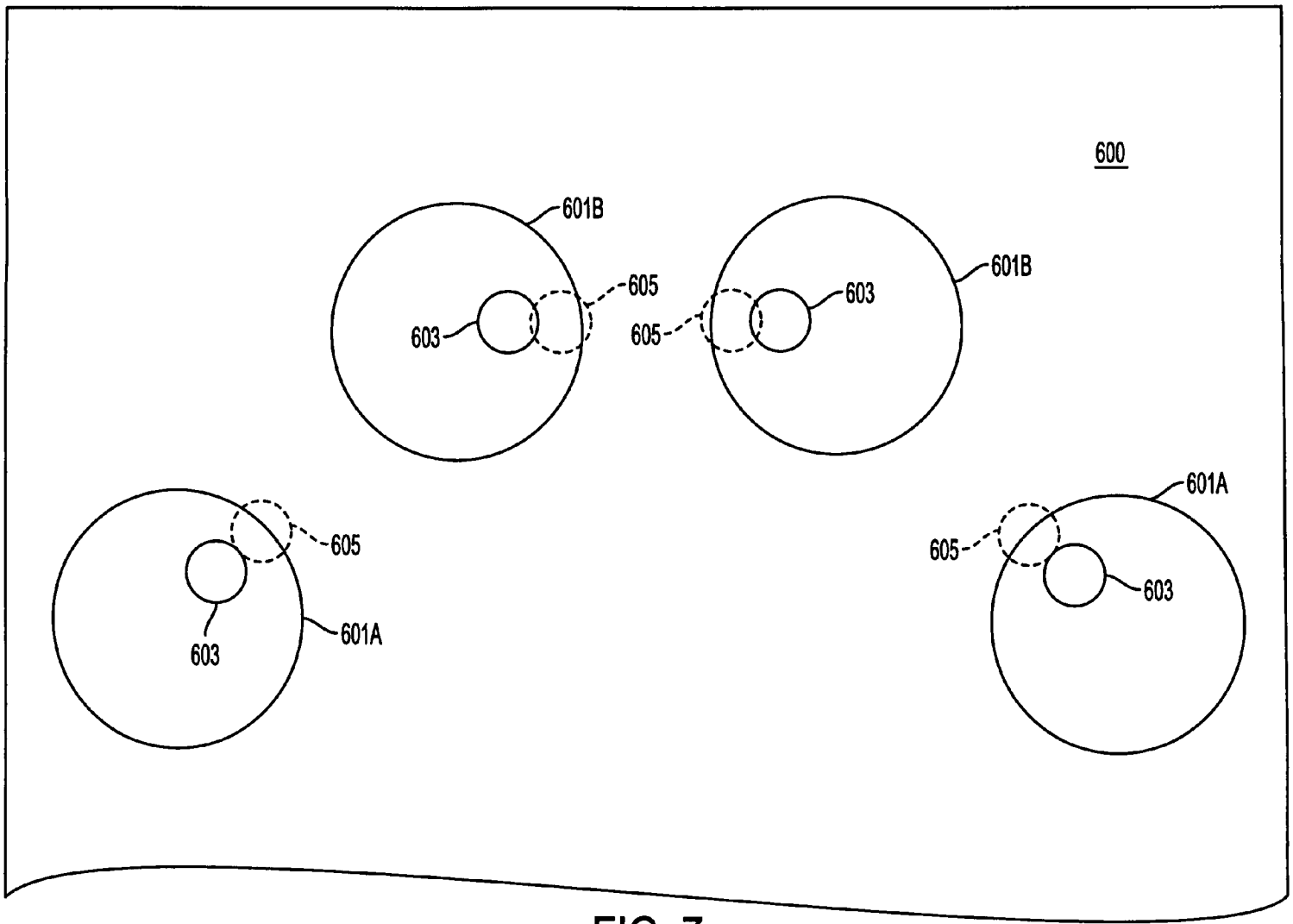
FIG. 7 provides the drawing of FIG. 6 further including a set of dashed circles representing the necessary locations for the mounting holes used by the new plate and blanket cylinders.

In an embodiment of the invention, the linear translation is significant enough that the mounting hole (503) breaches the exterior of the existing sleeve (501). FIGS. 6 and 7 provide conceptual illustrations of a system of this situation. In FIG. 6, there are shown a series of circles from one side of another press frame (600) which show the relationship of the existing bore holes and existing mounting holes. The large solid circles are the original bore holes (601) of the press (with the existing plate bore holes (601A) and existing blanket bore holes (601B) being subgroups), the small solid circles are the original mounting holes (603) of the sleeve. In FIG. 7, this image has been superimposed with small dashed circles which indicate the positions of the new mounting holes (605) to accommodate the smaller cylinders. As can be seen from FIG. 7, the new mounting holes (605) are outside the existing sleeve (overlap the bore holes (601)). Therefore, they would either have to be drilled directly into the frame and sleeve (which would be both unstable and undesirable) or an alternative method would need to be used.

Figure 8:
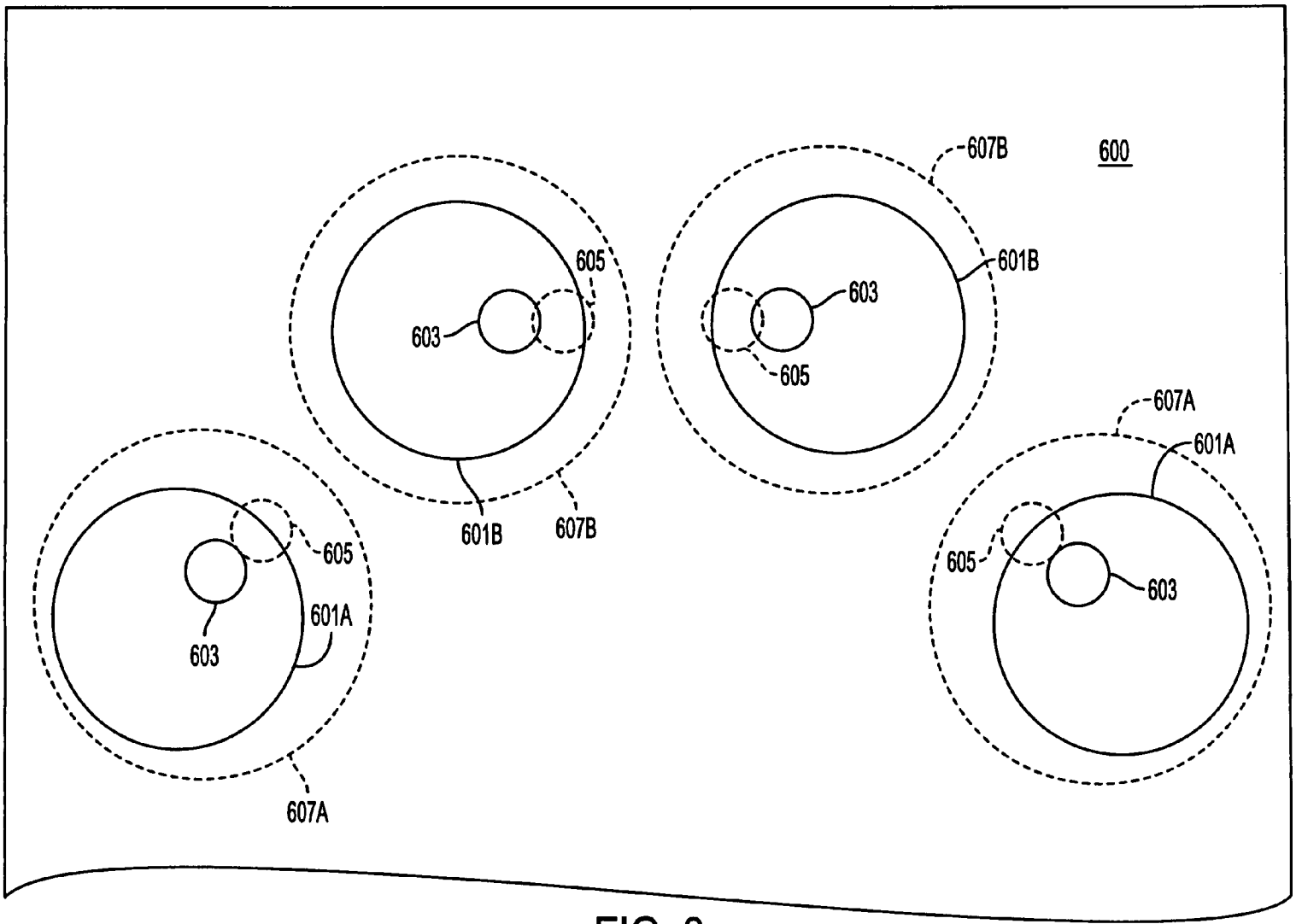
FIG. 8 provides the drawing of FIG. 7 further including a second set of dashed circles representing exemplary bore holes to provide for the use of the new mounting holes of FIG. 7.
Figure 9:
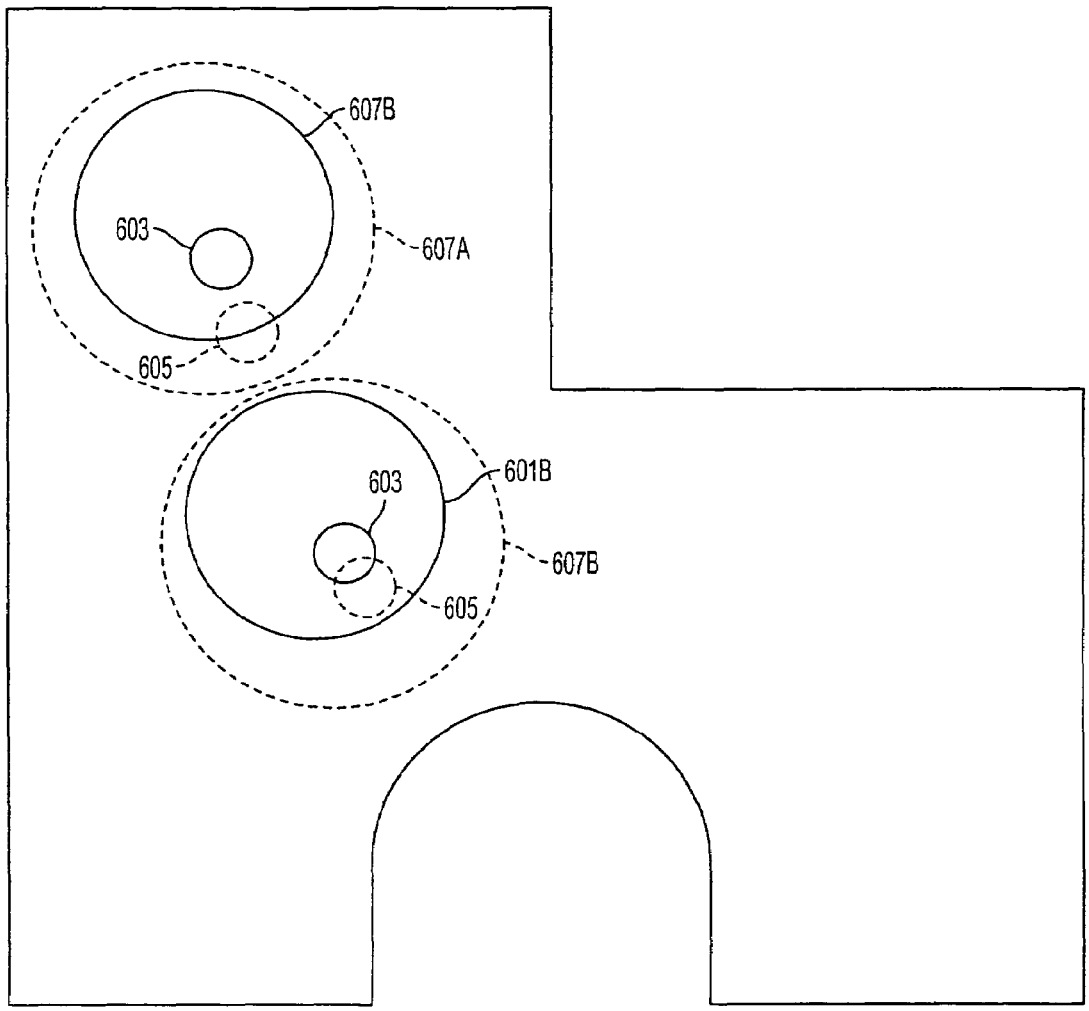
FIG. 9 provides a similar diagram to FIG. 8, but on a half deck module to be attached to the standard press unit of FIG. 8 to construct a three color press unit (a standard press unit with a half deck added on top of it).

FIG. 8 provides for new bore holes to enclose the new mounting holes (605). In FIG. 8 new bore holes (607) (with new plate bore holes (607A) and new blanket bore holes (607B) being subgroups) are provided which encompass both the entire original bore holes (601), and the new mounting holes (605). The new bore holes (607) are larger than the existing bore holes (601) as indicated. Further the axis of the new bore holes (607) may be linearly translated from the axis of the old bore holes (601). So long as these new bore holes (607) are larger and cover the entire area of the original bore holes (601) (encompass the original bore hole (601)), cover the area needed by the mounting hole (605), and do not contact any other new (607) or old (601) bore hole, they can act like the existing bore holes (601). New larger diameter sleeves can be placed therein with mounting holes (605) appropriately placed, and the press frame (600) has been adapted to use the smaller cylinders. A similar drawing to FIG. 8 but for a half deck is shown in FIG. 9. In FIG. 9, in addition to the cylinders of the half deck being able to interact with the common impression cylinder, a three-color press unit generally also requires the cylinders of the standard press unit to be able to operate in conjunction with the common impression cylinder. This design can lead to specific placements of the mounting holes within the sleeves of FIGS. 8 and 9.

While FIG. 8 provides for the system for allowing for the placement of the new bore holes (607), it should be clear that the exact placement of the new bore holes (607) requires precise alignment or else the cylinders will not interact correctly. In addition, the new bore holes (607) need to be machined on an existing press, not simply drawn in a conceptual drawing, and the boring needs to be done in a repeatable and relatively straightforward manner. Further, as should be apparent from the conceptual drawing, the actual location of the new bore holes (607) is not really dependent on any relationship to the frame, but instead the positioning of the new bore holes (607) relative to each other, and the new bore holes (607) relative to the old bore holes (601) is important as otherwise one of the needed interactions can be lost. Further, the new bore holes (607) in one side of the frame must be accurately aligned to the new bore holes (607) on the other side of the frame so that the cylinders are hung generally horizontally so the press works. Finally, so as to be economical, the operation of boring the holes needs to be relatively straightforward, and can allow for minimal error on the part of a human reconfiguring the press. Because of the design of the press, if a hole is bored incorrectly, the press unit may have to be scrapped resulting in a significant loss of time and money.

The process of trying to precisely align and bore the new holes relative to the old ones can be difficult as the reference items (the existing bore holes (601)) are all circles making determinations of exact horizontal and or vertical dimensions difficult. In order to correctly align the new bore holes (607), the preferred embodiment of the invention utilizes a series of specifically designed guides (called fixtures) to provide for straightforward repeatable boring operations to be performed on the frame.

One such series of these fixtures is shown in FIGS. 10-14 and 16. These fixtures utilize relationships based on the axes of the various existing bore holes (601), to quickly and straightforwardly align and machine the new bore holes (607). In particular, the fixtures recognize the inherent positioning of the old plate bore holes (601A) to the old blanket bore holes (601B) (to provide for the necessary contact in the original system), the relationship of the new plate bore holes (607A) to the new blanket bore holes (607B), the relationship (linear translation) between the axes of the new plate bore holes (607A) and the old plate bore holes (601A), and the relationship between the new blanket bore holes (607B) and the old blanket bore holes (601B). As would be apparent to one of ordinary skill in the art, the exact construction of the fixtures may vary by design choice, but the relationships of the various components and parts of the fixtures will generally be maintained so as to position a boring tool using the fixture in an appropriate position.

Further, the fixtures discussed are designed to accurately bore holes on any press unit to provide for new bore holes (607) to mount the new blanket and plate cylinders. In particular, the fixtures would be designed specifically for use with a press unit utilizing a predetermined first size of cylinders. However, the fixtures may be usable for press units which have a different size of original cylinders simply by using the appropriate connectors to connect it to the fixtures, if certain existing conditions were fulfilled. In the depicted embodiment, there are two sets of fixtures used. Each fixture set has two fixtures which are essentially mirror images and are designed for use on the two different sides (drive and operator) of the press unit. In another embodiment, the system may be utilized with a single fixture set, or two separate fixtures.

Figure 15:
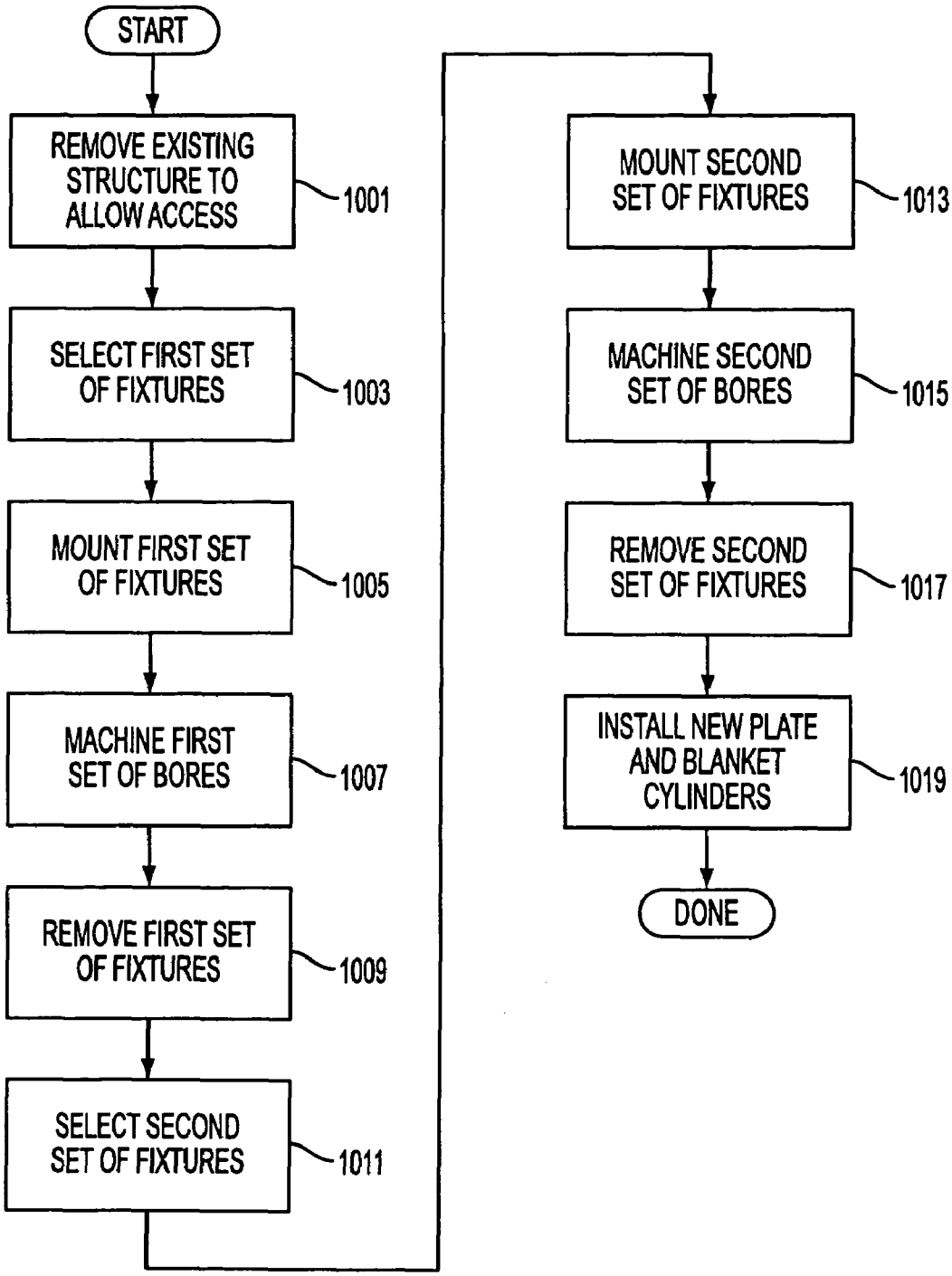
FIG. 15 provides for a flowchart of steps used to machine new bore holes in an existing frame for use with smaller diameter plate and blanket cylinders.

FIG. 15 provides a flowchart of an embodiment of a manner of use of the fixtures to machine the new bore holes (607A) and (607B). These steps would generally be performed by an operator or work team who is boring the press unit. Further, the arrangement of steps in FIG. 15 presumes that the fixtures are being used to bore all holes on both sides of a single press unit, and then the operator is moving to a new press unit. In an alternative embodiment, multiple sets of fixtures and/or multiple work teams or operators could be simultaneously performing steps on different press units.

An operator in step (1001) first removes the existing plate and blanket cylinders and the sleeves from the press unit frame and removes any ink and/or dampening rollers and other structure that may be necessary to access the sides of the press to place the fixture and to use the boring machine. Generally, access to the side will be obtained and the boring machine and fixture will be placed inside the frame of the press where the cylinders generally would be placed so that little external space is needed. The depiction of FIG. 2 shows a frame in this state.

Once the operator has access to the desired side of the press unit, the first fixture set is selected in step (1003). This first fixture set is designed to allow for the positioning and machining (or boring) of the first set of new bore holes based on the already existing positioning of the original other set of holes with one fixture being used on the drive side and a corresponding (and generally mirrored) fixture being used on the operator side. In the depicted embodiment, the plate bore holes are machined first, therefore, the plate bore aligning fixture set (901) is used which provides a guide for machining the new plate bore holes (607A) based on the positioning of the existing blanket bore holes (601B). In an alternative embodiment, however, the new blanket bore holes (607B) could be machined first. More specifics on the systems and methods for attaching the fixture will be discussed later.

The fixture of the first figure set are next aligned and attached to the frame in step (1005), the first new holes are then bored out of the frame (in this case, these are the new plate holes (607A)) in step (1007). Once these holes have been bored on both sides of the frame, the fixture set is removed in step (1009). A second fixture set is then obtained in step (1011) which provides for the position of the second set of holes, based on the position of the already bored new first set, again on both sides of the frame. In the depicted embodiment, this is the boring of the new blanket holes (607B). In this embodiment, the second fixture set is aligned and attached in step (1013) based on the position of the newly bored plate holes (607A), to align the boring guide to bore the new blanket holes (so blanket bore aligning fixture set (801) is used). Once the second fixture set is aligned and secured, the second set of holes are bored in step (1015) and the fixtures are removed in step (1017).

After the second fixture set is removed, the new plate (607A) and blanket (607B) holes have been bored for both sides of the frame. Once both sides of the frame have been bored, the new plate and blanket cylinders are placed in mounting holes in new sleeves which are then installed in the new bore holes (607) in step (1019). Due to the alignment of the positions for boring during the operation, the cylinders are correctly aligned to be used once so hung.

The steps of the method shown in FIG. 15 are merely exemplary of how the actions could be performed. In addition, in other embodiments, additional operations could be performed either before, during, or after these steps of FIG. 15. Bore holes for ink drums, other rollers used in the press unit, or other mechanisms may also be modified so that the press correctly transfers ink and dampener solution to the new plate and blanket cylinders, and so that the modified press unit correctly functions with the other components of the press line. Other drums or rollers utilizing bore holes in the frame may have these bore holes machined using modifications to the fixtures designed to accommodate their positioning, or may be bored using additional fixtures. Further, drive mechanisms or related structures may also be modified as necessary to interact with the new cylinders. Specifics of these modifications are beyond the scope of this disclosure which is focused on the critical positioning of the blanket and plate cylinders.

As can be seen from the above, the use of the dual fixtures which each align off the other provides for a relatively straightforward boring of the holes, which would otherwise be an extremely difficult task of multiple alignment and double checking.

Figure 12A:
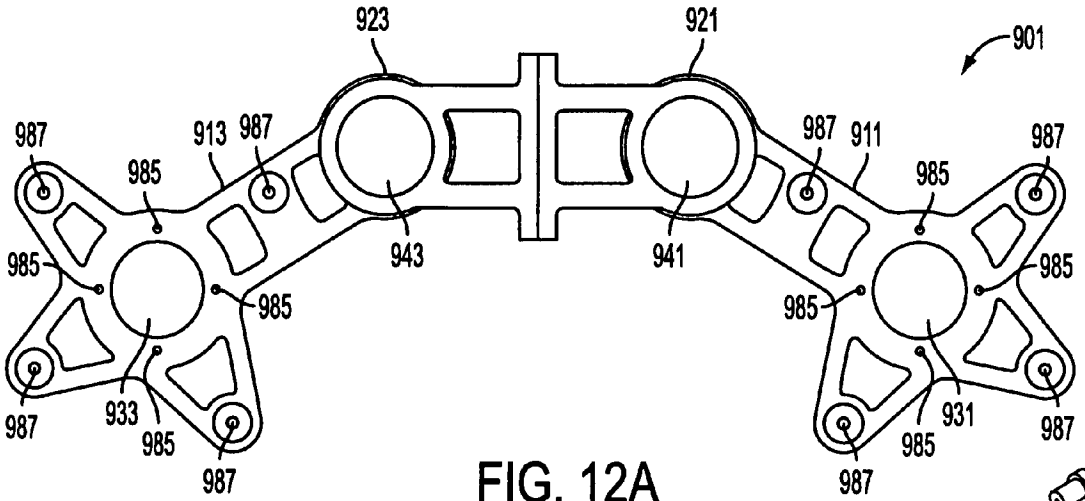
FIGS. 12A, 12B, and 12C provide various views of an embodiment of a set of plate bore aligning fixtures for correctly aligning the new plate bore holes based on the existing blanket bore holes on either the operator or drive side of the frame.
Figure 12C:
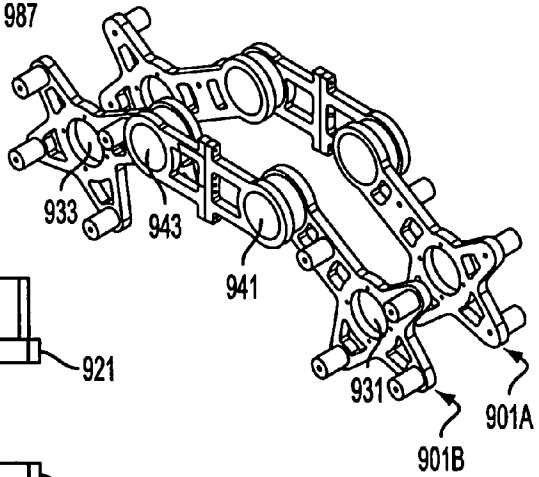
Figure 12B:
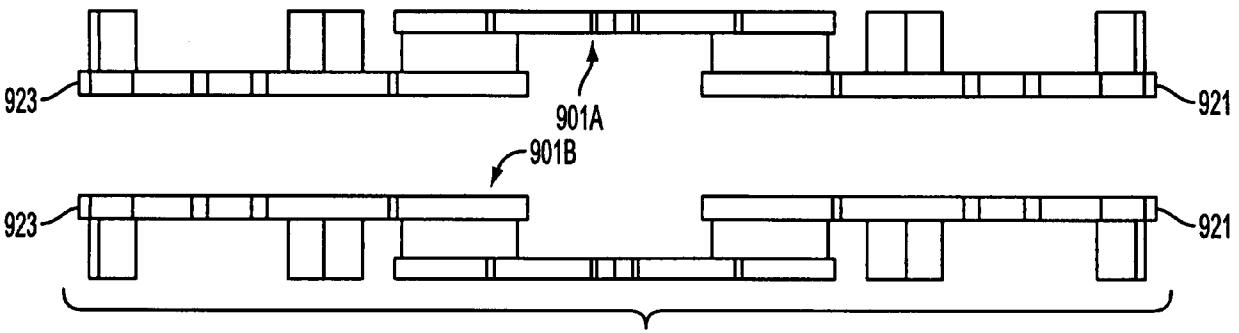

The fixtures are described in conjunction with FIGS. 10-14 and 16 below. Fixtures are used in a set where one fixture is used in conjunction with the drive side of the frame, while the other is used in conjunction with the operator side of the frame The first fixture set discussed is comprised of the plate bore aligning fixtures (901A) and (901B) for the drive and operator sides of the frame respectively. The plate bore aligning fixture set (901) is used for boring the new plate bore holes (607A) using the existing blanket bore holes (601B) for reference. Plate bore aligning fixture set (901) is shown in FIG. 12. The discussion will focus on one of the plate bore aligning fixtures (901A) but is equally applicable to the other plate bore aligning fixture (901B) as the two fixtures are essentially mirror images of the other.

The plate bore aligning fixture (901A) in the depicted embodiment is comprised of two halves (911) and (913) which are attached together in use. The halves (911) and (913) are arranged to be attached together utilizing pins allowing them to move linearly relative to each other so that slight variations in the separation of the old blanket bore holes (601B) (generally because they are horizontally separated by a slightly increased amount) can be compensated and/or so that the plate bore aligning fixture (901A) can be easier to position (as it will often be quite heavy). One half (911) is provided alone in FIG. 11 for reference. As shown in FIG. 12, each half comprises the frame (921) and (923), which is preferably constructed of a strong rigid material, such as, but not limited to, steel. The frames (921) and (923) are shaped so as to provide a blanket bore alignment hole (941) and (943) and a plate hole bore guide (931) and (933). The blanket bore alignment holes (941) and (943) are arranged so that they can be placed co-axial with the existing blanket bore holes (601B) when the plate bore aligning fixture (901A) is in place. The blanket bore alignment holes (941) and (943) are preferably round holes through the frame (921) or (923) of the plate bore aligning fixture (901A) of a predetermined diameter.

Figure 14B:
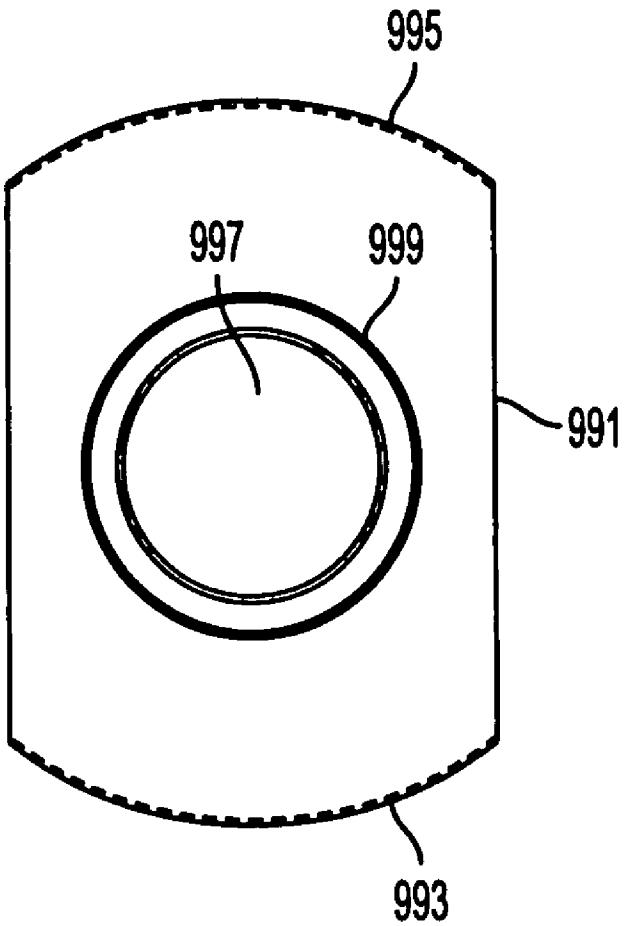
FIGS. 14A and 14B provide various views of an embodiment of a circle part for correctly aligning the existing blanket bore hole with the blanket alignment hole using the plate bore aligning fixture of FIG. 12.
Figure 14A:
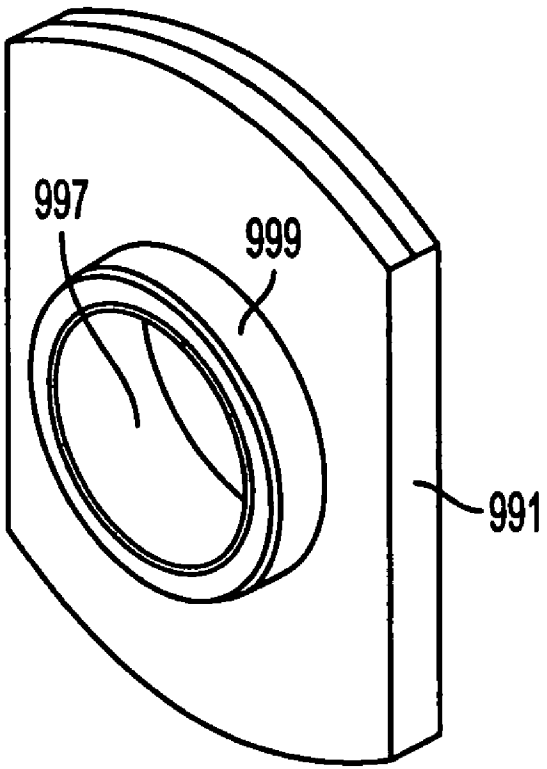

The alignment in the depicted embodiment is performed through the use of circle parts, such as blanket bore circle part (991) shown in FIG. 14. Blanket bore circle part (991) is a specifically sized and formed piece of material of generally rigid construction which can fit into the existing blanket bore hole (601B) at its outer diameter (the diameter of the edges (993) and (995)) and the blanket bore alignment hole (941) and (943) at its inner diameter (the outside diameter of the central tube (999)). Each blanket bore circle part (991), when placed in a hole of equal diameter (where a circle part's diameter is its longest dimension, or the diameter of the circle the blanket bore circle part (991) would form if the two circular edges (993) and (995) were continued), will always extend through the center axis of the hole, and the central tube (999) is arranged so as to be coaxial with the existing blanket bore (601B). The central tube (999) is then placed within the blanket bore alignment hole (941) or (943) (which generally has an internal diameter equal to the external diameter of the central tube (999)). At this time the plate bore aligning fixture (901A) is aligned correctly based on the placement of the existing blanket bore holes (601B) in the press unit.

Blanket bore circle part (991) includes an engagement hole (997) through its bulk which corresponds to the axis of the outer diameter of the blanket bore circle part (991). When blanket bore circle part (991) is in place in the existing blanket bore hole, a threaded rod (generally also of steel) (1101) can be placed through the engagement hole (997) in the blanket bore circle part (991) and therefore through the existing blanket bore hole (601B) and through the blanket bore alignment hole (941) and (943). A nut (1103) and a clamp bar (1105) may then be threaded or otherwise attached to either end of the threaded rod (1101) to draw the blanket bore circle part (991) (particularly the central tube (999)) into the blanket bore alignment hole (941) or (943) and hold the plate bore aligning fixture (901A) securely to the frame (600) This action will align the axes of the existing blanket bore holes (601B) and the blanket bore alignment holes (941) and (943).

Figure 16:
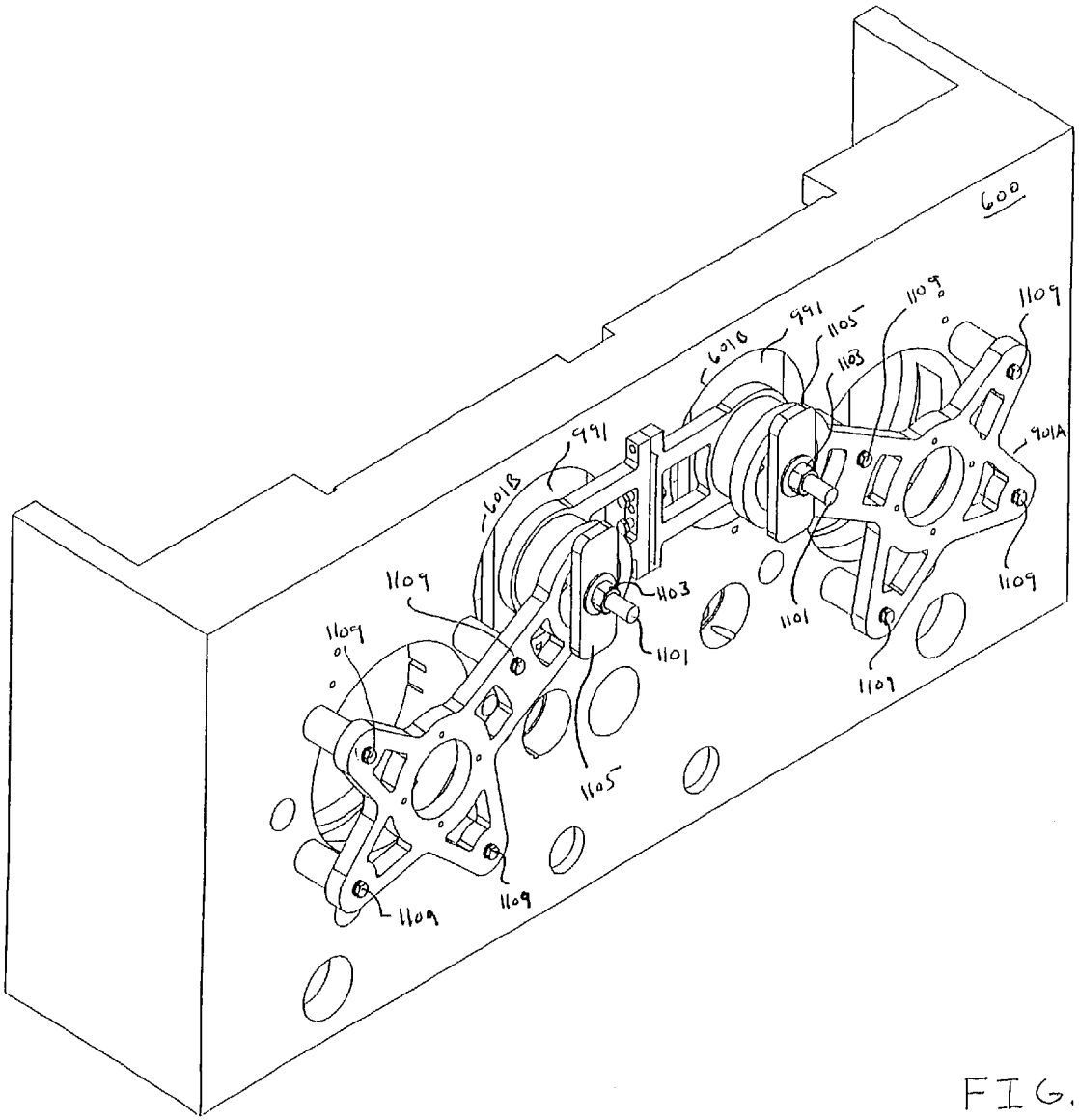
FIG. 16 provides a perspective view of the embodiment of a plate bore aligning fixture of FIG. 12 mounted as it would be on the frame of a press unit just prior to or just after boring.

When the threaded rod (1101) is so placed clamping everything together securely, plate bore aligning fixture (901A) has the blanket bore alignment holes' (941) and (943) axes coaxially aligned over the existing blanket bore holes' (601B) axis. When both blanket bore alignment holes (941) and (943) are so aligned with the appropriate existing blanket bore holes (601B), the fixture (901A) is correctly positioned. This positioning is shown in FIG. 16. Because the fixture (901A) is placed based on the two axes of two existing holes, and because the blanket bore circle parts (991), by their shape will automatically align the axes of the blanket bore alignment holes (941) and (943) and the existing blanket bore holes (601B), the fixture (901A) is in a precisely aligned position relative to the existing blanket bore holes (601B).

The plate hole bore guides (931) and (933) are now correctly aligned with the location where the new plate bore holes (607A) are to be machined. Therefore, the fixture (901) would usually be rigidly attached to the frame of the press unit to prepare for the boring operation. A series of mounting bolts, screws or rods (1109) are inserted through the mounting bolt holes (987) of each half (911) and (913) of the plate bore aligning fixture (901A) and into the frame (600) of the press unit. These mounting bolts (1109) serve to rigidly and securely attach the plate bore aligning fixture (901A) to the frame (600) of the press unit.

Once the plate bore aligning fixtures (901A) and (901B) of the fixture set (901) are both rigidly mounted, a boring tool will be brought into position. Generally, the fixtures shown in FIGS. 10-14 and 16 are designed to be used by an operator being physically inside the frame of the press, or standing where the blanket and plate cylinders would be when the press unit is operational. The boring tool would therefore also be brought inside the frame (600) of the press unit. The boring tool is then aligned with one of the plate hole bore guides (931) or (933) (generally by attachment through a bearing housing attached to the bore holding holes (985)), and the boring tool is used to bore into the frame (600) of the press unit to machine out the area dictated by the plate hole bore guide (931) or (933). This boring procedure is then repeated using the other plate hole bore guide (931) or (933). The entire procedure is also repeated on the other side of the frame.

After this process has been completed in the depicted embodiment, the bolts are removed from the bolt mounting holes (987) and the threaded rod (1101) and associated structures are also removed. This separates the plate bore aligning fixtures (901A) and (901B) from the frame of the press unit.

Figure 10A:
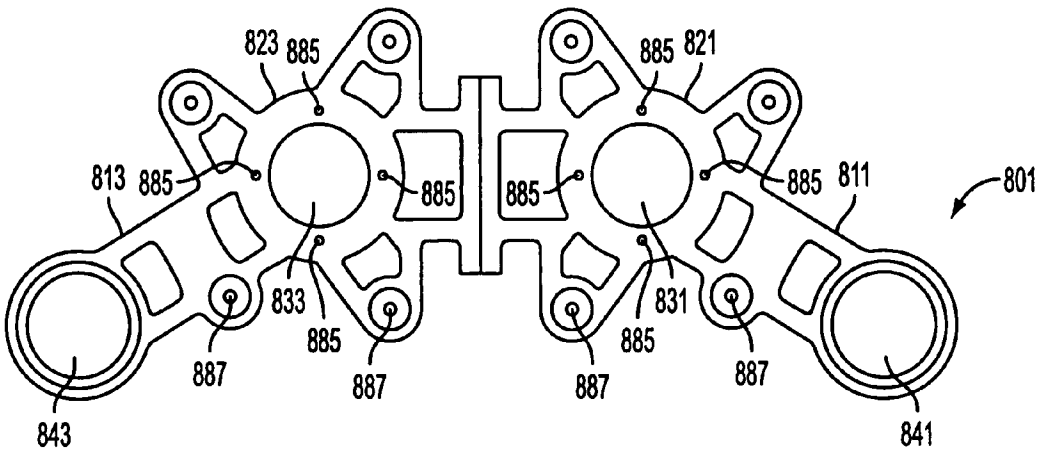
FIGS. 10A, 10B, and 10C provide various views showing a set of blanket bore aligning fixtures for correctly aligning the new blanket bore holes based on the new plate bore holes on either the operator or drive side of the press unit frame.
Figure 10C:
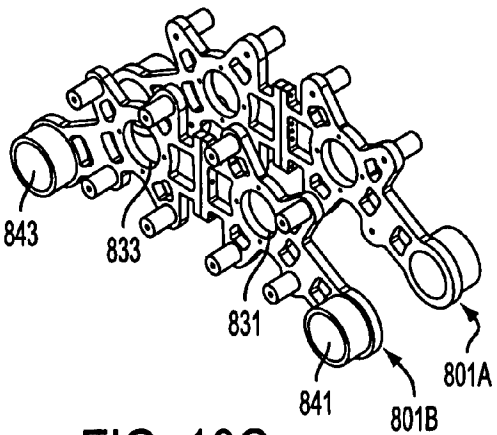
Figure 10B:
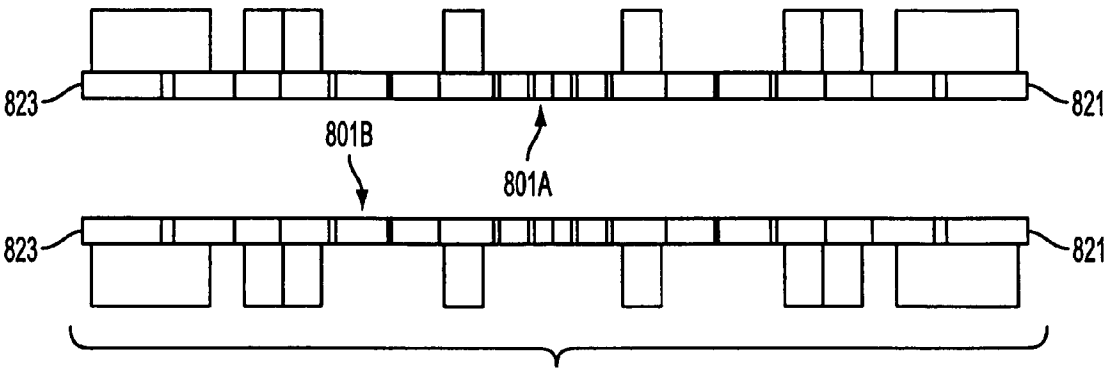
Figure 11:
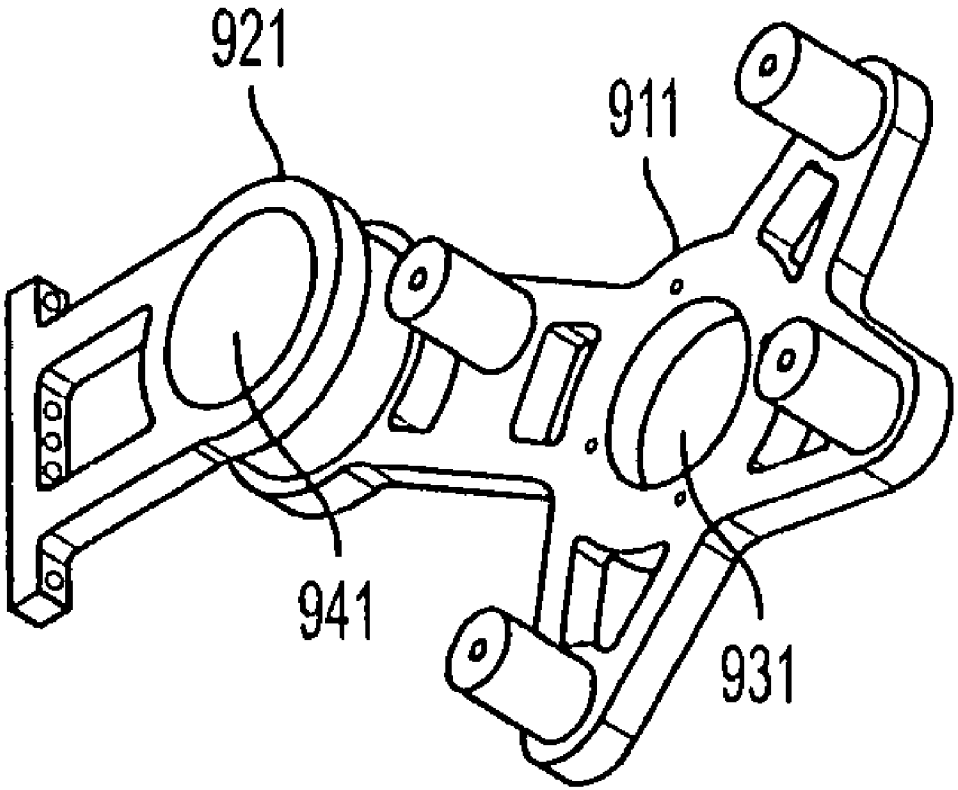
FIG. 11 shows a detail drawing of one separable half of one plate bore aligning fixture of FIG. 12.

In another embodiment, if the new blanket holes (607B) are to be coaxial with the old blanket holes (601B), the plate bore aligning fixture (901A) could have the blanket bore alignment holes (941) and (943) actually be the blanket hole bore guides (831) and (833) (currently shown on the blanket bore aligning fixture (801A) of FIG. 10). Because of the circle part (991) arrangement, the blanket bore alignment holes (941) and (943) would already correctly aligned (coaxial to the existing blanket bore holes (601B)) from the alignment operation. In this embodiment the boring tool would simply be aligned to drill through the blanket bore alignment holes (941) and (943), which are effectively the blanket hole bore guides (831) and (833) (in FIG. 10).

The depicted embodiment presumes that a separate set of fixtures is used for drilling the new blanket bore holes (607B) either for simplicity, or because the new holes may not be entirely coaxial with the old blanket bore holes (601B). The operator obtains the blanket bore aligning fixture set (801) shown in FIG. 10 which is designed to bore the new blanket bore holes (607B). The blanket bore aligning fixture set (801) is of generally similar design to the plate bore aligning fixture set (901) and again has two fixtures for the drive side (801A) and the operator side (801B) as well as two halves (811) and (813). The blanket bore aligning fixture (801A) operates in essentially the same way as the fixture (901A) (and correspondingly the discussion of blanket bore aligning fixture (801A) would be interchangeable with a discussion of blanket bore aligning fixture (801B)), however, the blanket bore aligning fixture (801A) is designed to interact with the location of the new plate bore holes (607A) while the plate bore aligning fixture (901A) utilized the existing blanket bore holes (601B).

Figure 13B:
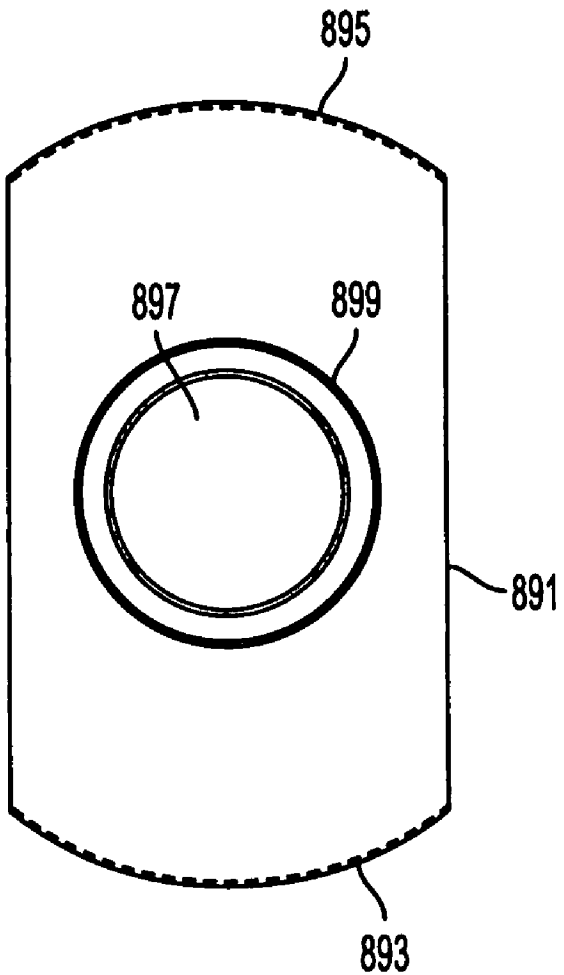
FIGS. 13A and 13B provide various views of an embodiment of a circle part for correctly aligning the new plate bore hole with the plate alignment hole using the blanket bore aligning fixture of FIG. 10.
Figure 13A:
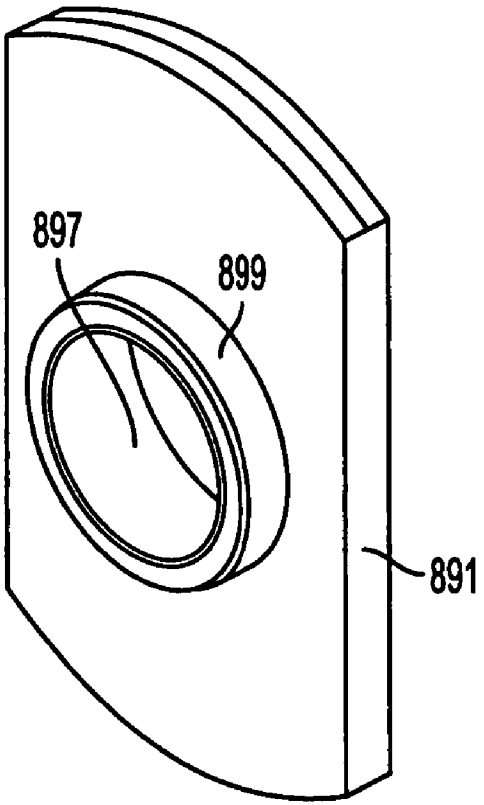

The operator places the plate alignment holes (841) and (843) over the new plate bore holes (607A) and again, using plate bore circular parts (891) (which will generally be of different outer diameter as the new plate bore holes (607A) are generally of different diameter to the old blanket bore holes (601B)) such as those shown in FIG. 13, the plate alignment holes (841) and (843) are aligned with the new plate bore holes (607A). Again a threaded rod is used to pull the fixture (801A) to the frame (600) placing the outer diameter of the central tube (999) within the plate alignment holes (841) and (843) and mounting bolts are inserted through the mounting bolt holes (887) rigidly attaching the fixture (801A) frames (821) and (823) to the frame of the press unit. Once both fixtures (801A) and (801B) are rigidly attached, the boring tool is again brought into position, and is aligned to cut a bore in the area indicated by the blanket hole bore guides (831) and (833) (generally by attachment through a bearing housing attached to the bore holding holes (885)) this time drilling new blanket cylinder bore holes (607B) on both sides of the frame (600). Once completed, the fixture set (801) is then removed.

After this operation has been completed, the four new bores on each side of the press have all been machined. The new bore holes (607) can then be filled by new sleeves (designed to incorporate the relationships of mounting holes shown in FIG. 8) and the journals of the new blanket and plate cylinders can be placed in the mounting holes therein, precisely aligned for operation.

After the above bores have been machined it may be necessary to alter other components of the press unit and/or press line so that the new print size is used correctly. For instance, this alternation will usually require new gearing to change the ratio to match the smaller diameter cylinders. The ink train would also probably require some new rollers and mounting brackets to allow the rollers to make contact with the new smaller plate cylinders. The common impression cylinder will also usually be replaced with a common impression cylinder of a larger diameter, and/or new bore holes may be drilled for that piece. The dampener mounting bracket may also have to be modified to match the smaller plate cylinders. Sidelay and circumferential assemblies may be designed to match the new bore hole design as they generally attach to the ends of the new cylinders. All of these operations can be performed utilizing similar fixture constructions (if boring in the frame is required) or may be standard engineering alterations (such as gear ratios) as would be known to those of ordinary skill in the art.

While it is only briefly discussed here, as the exact design is generally beyond the scope of this discussion, the folder unit (121) would also generally be modified to accommodate the new page size. There will generally be a cassette consisting of a folding and cutting cylinder of the new diameters (related to the diameter of the plate and blanket cylinders) that will allow for folding and cutting of the new cut-off length. Gearing throughout the folder (121) would then be designed to match the new folding and cutting cylinders. Finally, angle bars (111) and idle rollers throughout the system may be adjusted to provide for the ability to correctly register the pages from all the printing units of the press line which all have been modified for the new cut-off length.

As should be apparent from the figures, the systems and methods discussed herein generally allow for the modification of an existing printing press to accommodate a smaller cut-off. This operation is generally designed to be performed in a straightforward repeatable fashion on multiple press units through the use of fixtures which provide for the correct alignment of new bores based on the axial locations of the old bores. Further, the systems and methods allow for the modification of the press units on site and in the press line, so long as the press line can be shut down during the period of modification and it is not necessary to remove the press unit from the press line which can entail significant extra expense. This can allow for more economical modification as it is not necessary to remove the heavy presses and then return them once they have been modified.

While the above discussion discloses a preferred embodiment of the invention which utilizes only the existing frame of the press unit as the support for the new bore holes which are cut directly into the existing frame, this is not the only embodiment of the invention. In an alternative embodiment, the holes may be bored through a new frame component for the press, before the modification takes place. For instance, the holes may be machined in a piece of cast iron prior to the press being taken off line. This piece of cast iron may then be brought to the press on site, and welded, bolted, clamped or otherwise rigidly attached on the inside of each of the sides of the frame of the press unit. Then cylinders of a shorter length and the decreased diameter could be mounted on sleeves through the new bores as discussed previously without having to modify extensively the existing frame structure. While this can be a time-saving embodiment in some situations, this embodiment has the disadvantage that the new plate and blanket cylinders are necessarily shorter than the existing cylinders. If the press operation used the full width of the old cylinder in printing the pages, this length reduction would not be allowed.

In still another embodiment, the existing bore holes may be filled (or partially filled) with a rigid material (such as a resin, plastic, or metal) once the cylinders have been removed, and completely new bore holes be machined therethrough. This can allow for an incomplete overlap of the new and old bore holes (allowing the new bore holes to have the same or a decreased diameter when compared to the old) without loosing functionality, but will generally be a more time consuming operation and will often result in the frame of the press unit having a weaker structure than the depicted embodiment.

While the invention has been disclosed in connection with certain preferred embodiments, this should not be taken as a limitation to all of the provided details. Modifications and variations of the described embodiments may be made without departing from the spirit and scope of the invention, and other embodiments should be understood to be encompassed in the present disclosure as would be understood by those of ordinary skill in the art.

The invention claimed is:

1. A system for machining new bore holes for mounting blanket and plate cylinders in a printing press unit, the system comprising:

said printing press unit;

a fixture, mountable to and removable from said printing press unit, comprised of a rigid material;

at least one alignment hole machined through said fixture; and at least one bore hole guide machined through said fixture;

wherein said at least one alignment hole is aligned to at least one of a plate bore hole or a blanket bore hole of said printing press unit; and wherein, when said at least one alignment hole is so aligned, said bore hole guide indicates a position to machine a new hole in said printing press unit.

2. The fixture of claim 1 wherein said fixture is one of two fixtures in a set of fixtures.

3. The fixture of claim 1 wherein said fixture is separable into at least two parts.

4. A system for machining new bore holes for mounting blanket and plate cylinders in a printing press unit, the system comprising:

said printing press unit;

a fixture, mountable to and removable from said printing press unit, comprised of a rigid material; at least one alignment means in said fixture wherein said at least one alignment means may be aligned to at least one of a plate bore hole or a blanket bore hole of said printing press unit; and at least one bore guiding means in said fixture wherein when said at least one alignment means is aligned to said at least one of said plate bore hole or said blanket bore hole, said bore guiding means guides boring of a new hole in said printing press unit.

5. The fixture of claim 4 wherein said new hole is drilled to replace at least one of said plate bore hole and said blanket bore hole.

6. The fixture of claim 5 wherein said new hole replaces a plate bore hole or blanket bore hole to which said alignment means is not aligned.

7. A system for machining new bore holes for mounting blanket and plate cylinders in a printing press unit, the system comprising:

said printing press unit;

a first fixture comprising:

a first frame, mountable to and removable from said printing press unit, comprised of a rigid material;

a first alignment hole machined through said first frame; and a first bore hole guide machined through said first frame;

wherein said first alignment hole is aligned to a blanket bore hole of said printing press unit; and wherein, when said first alignment hole is so aligned, said first bore hole guide indicates a position to machine a first new plate bore hole in said printing press unit; and a second fixture comprising;

a second flame, mountable to and removable from said printing press unit, comprised of a rigid material;

a second alignment hole machined through said second frame; and a second bore hole guide machined through said second frame;

wherein said second alignment hole is aligned to said new plate bore hole of said printing press unit; and wherein, when said second alignment hole is so aligned, said bore hole guide indicates a position to machine a new blanket bore hole in said printing press unit.

8. The system of claim 7 further comprising two copies of said first fixture and two copies of said second fixture.

* * * * *